US008142274B2

(12) United States Patent
Baerlocher

(10) Patent No.: US 8,142,274 B2
(45) **Date of Patent: *Mar. 27, 2012**

(54) GAMING DEVICE HAVING AN AWARD DISTRIBUTOR AND AN AWARD ACCUMULATOR BONUS GAME

(75) Inventor: Anthony J Baerlocher, Reno, NV (US)

(73) Assignee: IGT, Reno, NV (US)

( * ) Notice: Subject to any disclaimer, the term of this patent is extended or adjusted under 35 U.S.C. 154(b) by 763 days.

This patent is subject to a terminal disclaimer.

(21) Appl. No.: 12/014,491

(22) Filed: Jan. 15, 2008

(65) Prior Publication Data

US 2008/0113760 A1 May 15, 2008

Related U.S. Application Data

(63) Continuation of application No. 11/331,669, filed on Jan. 13, 2006, now Pat. No. 7,326,109, which is a continuation of application No. 10/715,796, filed on Nov. 18, 2003, now Pat. No. 7,004,835, which is a continuation of application No. 09/682,369, filed on Aug. 24, 2001, now Pat. No. 6,663,489.

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS 4,695,053 A 9/1987 Vazquez, Jr. et al.
5,342,047 A 8/1994 Heidel et al.
5,393,057 A * 2/1995 Marnell, II ..... 463/13
5,647,798 A * 7/1997 Falciglia ..... 463/19
5,823,874 A 10/1998 Adams
5,848,932 A * 12/1998 Adams ..... 463/20
5,882,261 A 3/1999 Adams
5,911,418 A 6/1999 Adams
5,951,397 A 9/1999 Dickinson
5,971,849 A * 10/1999 Falciglia ..... 463/16

(Continued)

FOREIGN PATENT DOCUMENTS

EP 0945837 A2 9/1999

(Continued)

OTHER PUBLICATIONS

Video Wheel of Fortune Brochure written by IGT, published in 1999.

(Continued)

*Primary Examiner* — Dmitry Suhol
*Assistant Examiner* — Michael Grant
(74) *Attorney, Agent, or Firm* — K&L Gates LLP

(57) ABSTRACT

A gaming device that enables players to accumulate awards by activating an award distributor having a plurality of award symbols and at least one selection group activator symbol. The gaming device provides the player with a plurality of activations where an award is associated with each award symbol indicated in each activation. When a selection group activator symbol is indicated, the gaming device displays at least one selection set having a plurality of selections associated with selection awards. The gaming device enables a player to select one selection and provides the associated selection award to the player. The number of available selections in the selection set decreases by one after the player picks a selection. If the selection group activator symbol is subsequently indicated, the player picks from the remaining available selections in the selection set.

10 Claims, 19 Drawing Sheets

U.S. PATENT DOCUMENTS

| | | | | |
|---|---|---|---|---|
| 5,980,384 | A | 11/1999 | Barrie | |
| 5,997,401 | A | 12/1999 | Crawford | |
| 6,015,346 | A | 1/2000 | Bennett | |
| 6,089,976 | A | 7/2000 | Schneider et al. | |
| 6,089,978 | A | 7/2000 | Adams | |
| 6,102,798 | A | 8/2000 | Bennett | |
| 6,120,031 | A | 9/2000 | Adams | |
| 6,126,542 | A | 10/2000 | Fier | |
| 6,159,095 | A | 12/2000 | Frohm et al. | |
| 6,159,097 | A | 12/2000 | Gura | |
| 6,159,098 | A * | 12/2000 | Slomiany et al. | 463/25 |
| 6,174,235 | B1 | 1/2001 | Walker et al. | |
| 6,190,255 | B1 | 2/2001 | Thomas et al. | |
| 6,210,279 | B1 | 4/2001 | Dickinson | |
| 6,217,448 | B1 * | 4/2001 | Olsen | 463/25 |
| 6,224,483 | B1 | 5/2001 | Mayeroff | |
| 6,364,766 | B1 * | 4/2002 | Anderson et al. | 463/16 |
| 6,413,161 | B1 | 7/2002 | Baerlocher et al. | |
| 6,439,995 | B1 | 8/2002 | Hughs-Baird et al. | |
| 6,565,436 | B1 | 5/2003 | Baerlocher | |
| 6,582,306 | B1 | 6/2003 | Kaminkow | |
| 6,663,489 | B2 | 12/2003 | Baerlocher | |
| 6,852,028 | B2 | 2/2005 | Vancura | |
| 7,004,835 | B2 | 2/2006 | Baerlocher | |

FOREIGN PATENT DOCUMENTS

| | | |
|---|---|---|
| EP | 0984409 A2 | 3/2000 |
| WO | WO00/12186 | 3/2000 |

OTHER PUBLICATIONS

Wheel of Fortune Brochure written by IGT, published in 1998.
Top Dollar Brochure written by IGT, published in 1998.
Neon Nights Brochure written by IGT, published in 2000.
Neon Nights Article written by Strictly Slots, published in Dec. 2000.
Texas Teas Brochure written by IGT, published in 2000.
Winning Bid Brochure written by WMS Games, Inc., published prior to 2001.
Fortune Cookie Brochure written by IGT, published in 2000.
Cash Box Advertisement written by Anchor Games/IGT, published in 2000.
Regis Cash Club Advertisement written by IGT, published in 2002.
Jackpot Party Brochure and Articles written by WMS Gaming, Inc., published in 1998.
By George Advertisement written by IGT, gaming device shown in Oct. 2000, advertisement, published in 2002.

* cited by examiner

GAMING DEVICE HAVING AN AWARD DISTRIBUTOR AND AN AWARD ACCUMULATOR BONUS GAME

PRIORITY CLAIM

This application is a continuation of and claims the benefit of U.S. patent application Ser. No. 11/331,669, filed on Jan. 13, 2006, which is a continuation of and claims the benefit of U.S. patent application Ser. No. 10/715,796, filed on Nov. 18, 2003, which is a continuation of and claims the benefit of U.S. patent application Ser. No. 09/682,369, filed on Aug. 24, 2001, the entire contents of which are incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device, and more particularly to a gaming device having an award distributor and an award accumulator bonus game.

Gaming device manufacturers strive to make gaming devices that provide as much enjoyment and excitement as possible. Providing a bonus game in which a player has an opportunity to win potentially large awards or credits in addition to the awards associated with the base game of the gaming device is one way to enhance player enjoyment and excitement.

Known gaming devices having bonus games employ a triggering event that occurs during play of the base game operation of the gaming device. The triggering event temporarily stalls or halts the base game play and enables a player to enter a second, different game, which is the bonus game. The player plays the bonus game, likely receives an award, and returns to the base game. In most instances, the bonus game is relatively short in relation to the time that the player spends repeatedly playing the base game. The player may play the bonus game several times while playing the base game of the gaming device.

One known commercially available gaming device is the "WHEEL OF FORTUNE™" gaming device. This gaming device includes a multi-colored bonus award wheel attached to the cabinet of the gaming device. The award wheel is divided into several sections. Each section includes an award that ranges in value from twenty-five to one thousand. In this game, a player plays a base game that includes spinning reels and a central payline. When a wheel symbol is positioned along the central payline on the third reel, the player enters the bonus game.

In the bonus game, the player obtains one opportunity or spin of the award wheel. The player spins the award wheel by pressing a button on the gaming device. Once the award wheel starts spinning, the player waits until it stops. An indicator located at the top of the award wheel points to a section of the wheel. The player receives the award on that section for the bonus game. After the player receives that award, the bonus game ends and the player may resume playing the base game.

Another bonus game is disclosed in U.S. Pat. No. 6,089,978. This patent discloses a bonus game which is triggered when a player obtains a winning combination of symbols on a plurality of reels. The bonus game is initiated and includes an award wheel with different bowling awards such as a spare and strike, indicated on the wheel. The gaming device provides the player with ten frames in the bonus game. The player presses a "Roll the Ball" button to initiate the spinning of the wheel. Once the wheel stops spinning, the player receives the score indicated on the wheel for a particular frame. The player spins the award wheel to obtain a score for each frame until all of the frames are completed. After the tenth and final frame is completed, the player's scores from all of the frames are totaled and provided to the player as a bonus award for the bonus game.

There are also many known bonus games that provide the player the opportunities to pick selections from a plurality of selections.

While such bonus games offer advantages in player appeal and excitement, there is a continuing need to develop new types of bonus games that allow players to accumulate larger awards and increase the level of player excitement and enjoyment.

SUMMARY OF THE INVENTION

The present invention provides a gaming device and in particular a bonus game of a gaming device that enables players to accumulate awards by activating an award distributor (such as an award wheel) having a plurality of awards or award symbols and at least one selection group activator symbol. The gaming device provides the player with a plurality of activations of the award distributor. An award symbol or a selection group activator symbol is indicated in each activation of the award distributor. When an award symbol is indicated, the processor of the gaming device provides the award indicated to the player. When a selection group activator symbol is indicated, the gaming device displays or highlights a plurality of selections. A selection set or selection award is associated with each selection. Preferably, the selection set or selection awards range from low to high value awards. The game enables a player to select one selection from the selection set and provides the selection award associated with that selection to the player. The number of available selections in the set thereby decreases by one after the player picks the selection. The game then returns to the award distributor. If the selection group activator is subsequently indicated, the gaming device displays or highlights the plurality of remaining selections in the selection set. The probability that the player will pick a selection having a particular selection award (such as a high value award) accordingly increases after each picked selection in the selection set because there are less available selections for the player to pick from in the selection set. In this embodiment, the gaming device provides the player with one selection set having a predefined number of selections when a selection group activator symbol is indicated by the distributor.

In an alternative embodiment, the bonus game includes two or more separate activator symbols displayed by the distributor. In this embodiment, the symbols are associated with different selection sets and each set has a predefined number of selections. The awards associated with each selection set, preferably vary, such that the awards associated with selections in one selection set are on average, larger than the awards associated with selections in the other selection set.

In a further alternative embodiment, the gaming device provides the player with a plurality of selection sets having a predefined number of selections when a selection group activator symbol is indicated by the distributor. The gaming device randomly determines which selection set to provide to the player.

In yet another alternative embodiment, the distributor includes at least one terminator or terminator symbol. If a terminator symbol is indicated by the distributor, the bonus game ends.

As indicated above, in one embodiment, the player has a predetermined number of activations of the award distributor. Alternatively, the processor can randomly determine the number of spins. In a further alternative embodiment, the gaming device enables the player to obtain a number of additional spins at the beginning of the bonus game. The player picks from a plurality of masked choices to obtain the number of spins or additional spins associated with the player's choice.

In another alternative embodiment, the award symbols and selection group activator symbols are associated with probabilities such that an award symbol or selection group activator symbol has a greater probability of being implemented in the game than another award symbol or selection group activator symbol.

Although the present invention is discussed relative to a bonus game of a gaming machine, it should be appreciated that the present invention could be employed as a primary game in a gaming device.

It is therefore an advantage of the present invention to provide a gaming device having an award distributor that has a plurality of award symbols and at least one selection group activator symbol, where a player obtains the award indicated after each spin of the award wheel and picks a selection award from a plurality of selections in a selection set if a selection group activator symbol is indicated.

It is another advantage of the present invention to increase the probability that a player will pick a particular bonus award from a plurality of selections by reducing the number of available selections from a selection set.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
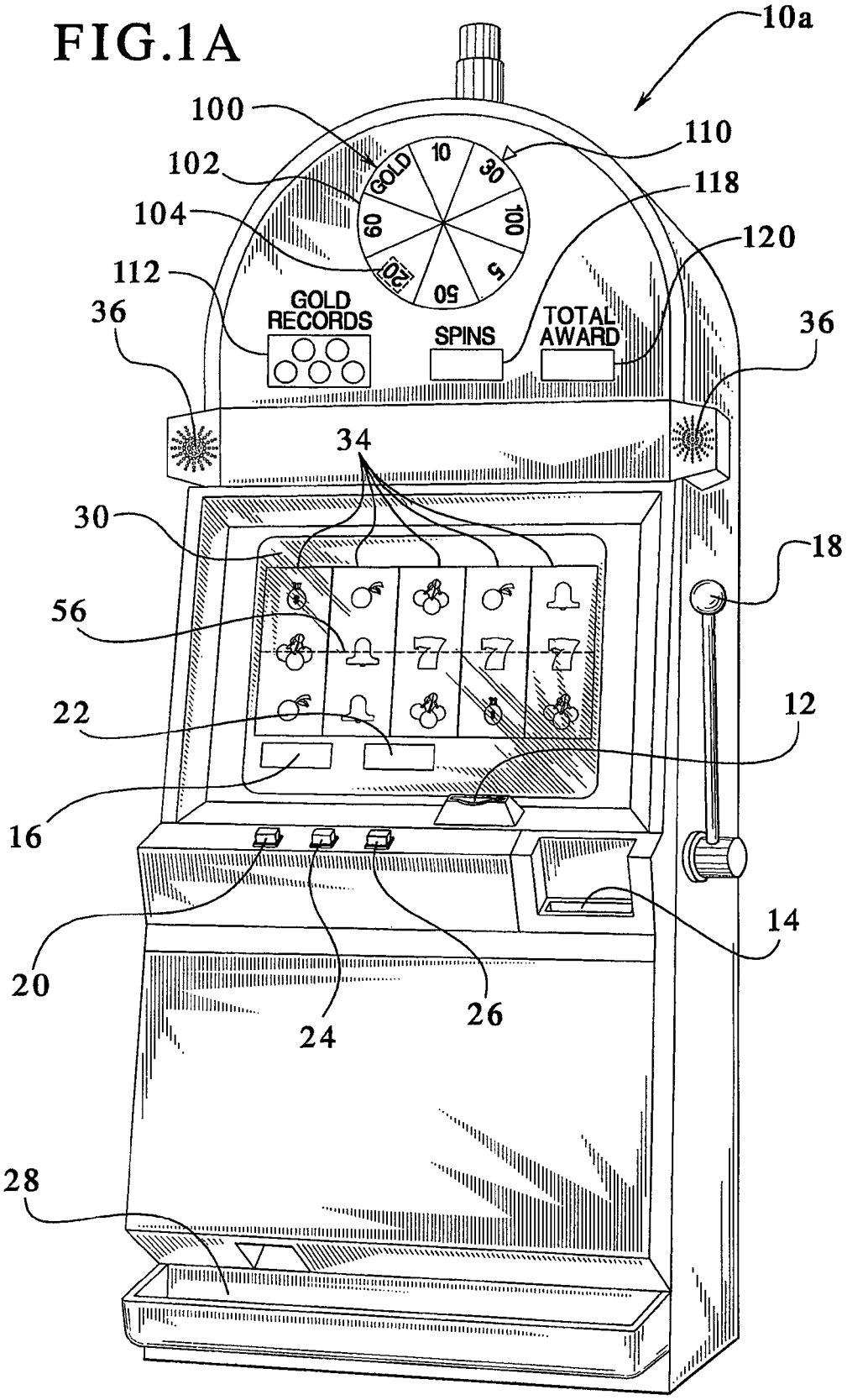
FIG. 1A is a front perspective view of one embodiment of the gaming device of the present invention.
Figure 1B:
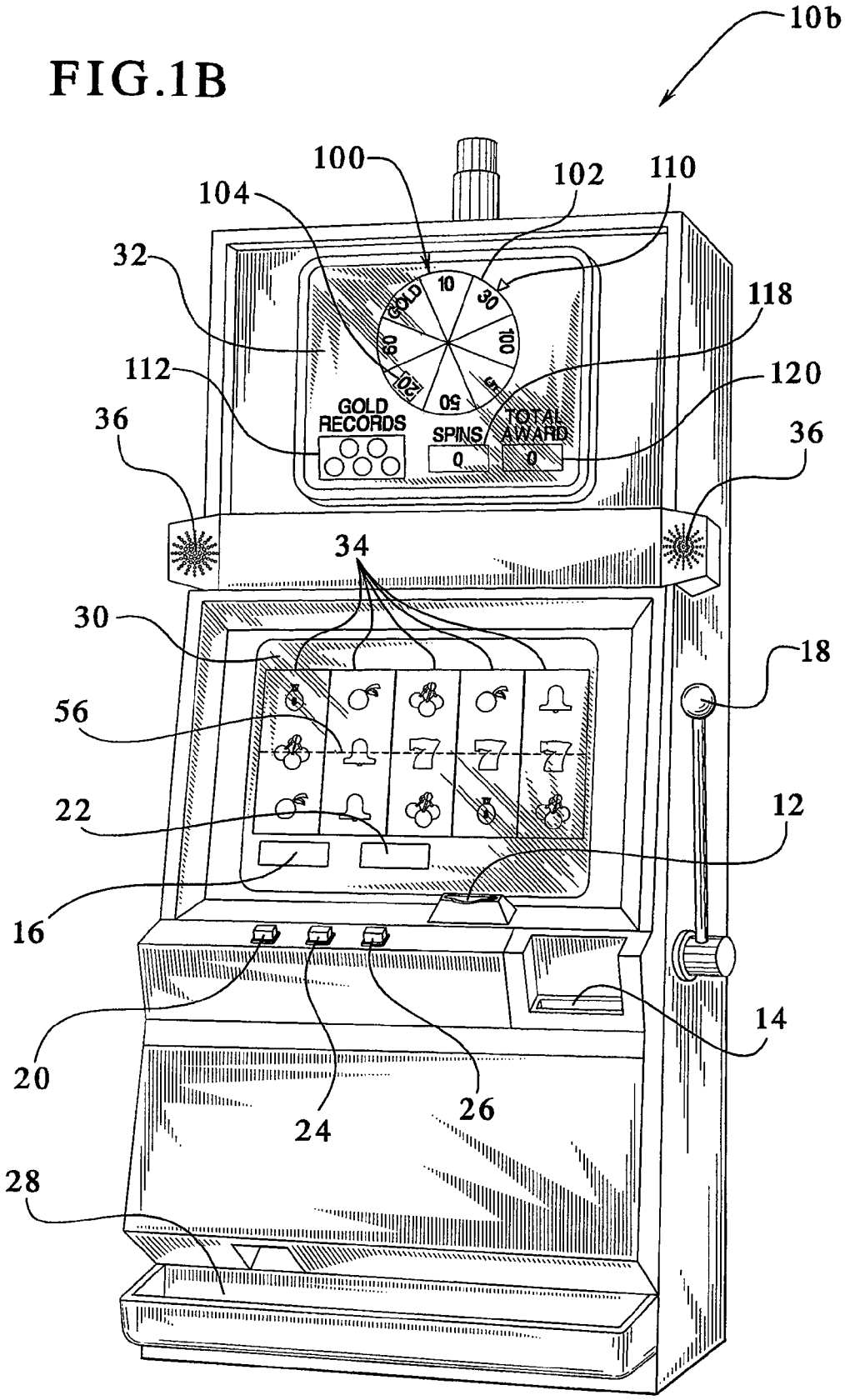
FIG. 1B is a front perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, black jack, poker or keno, any of the bonus triggering events and any of the bonus round games. The symbols and indicia used on and in gaming device 10 may be in mechanical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30 and an award distributor in the form of a mechanical award wheel 100 that physically spins in front of a player. The award wheel is divided into a plurality of sections 102 where a section is indicated by section indicator 110. The alternative embodiment shown in FIG. 1B includes a central display device 30 as well as an upper display device 32. The upper display device 32 displays the award distributor in the form of an award wheel 100 of the present invention in a video format.

Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
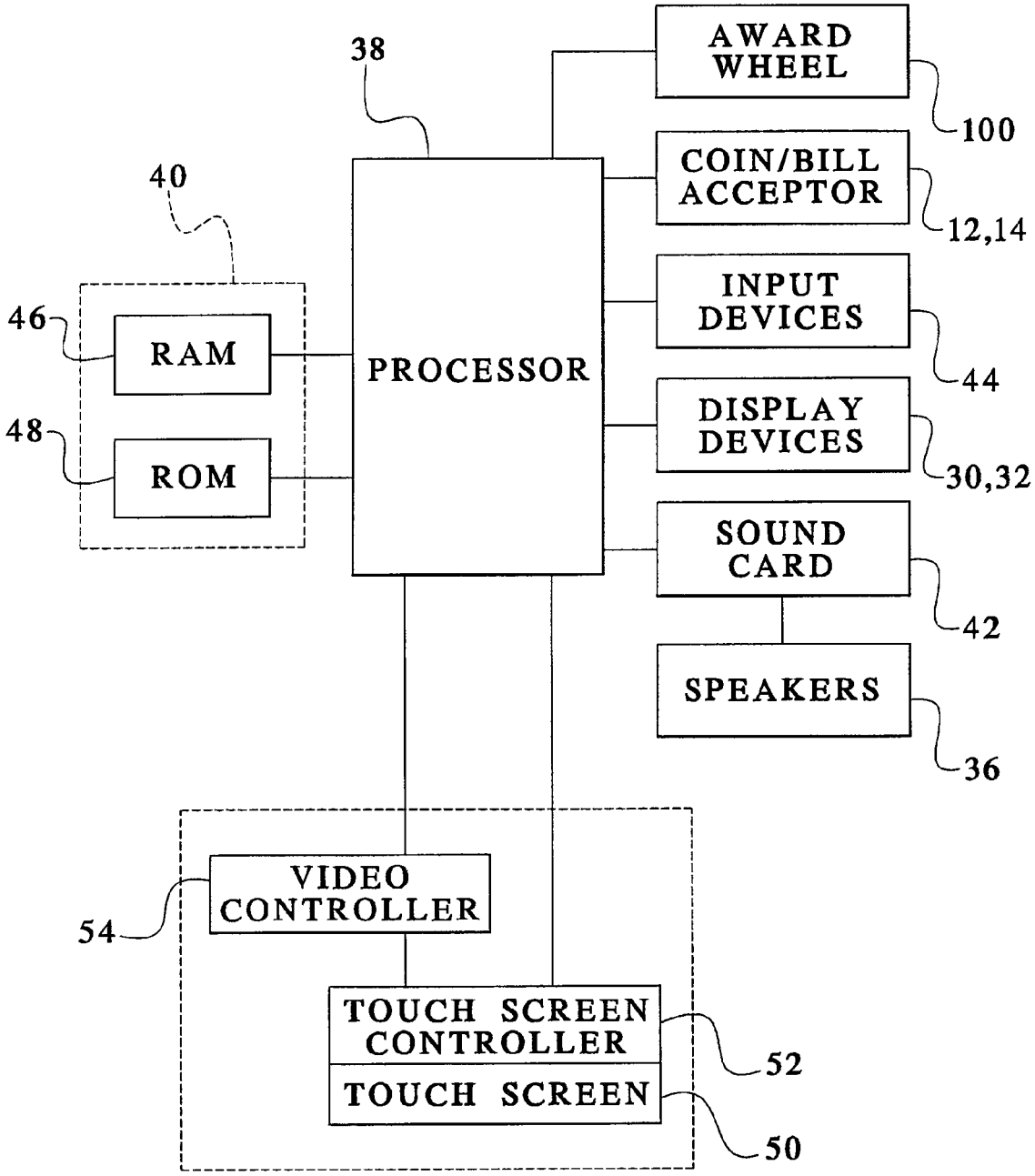
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32 or an award distributor in the form of an award wheel 100 in the mechanical format of the bonus game; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Game

One embodiment of the bonus game of the present invention includes an award distributor and one selection set having a plurality of selections. The award distributor includes a plurality of award symbols and at least one selection group activator symbol. The gaming device provides the player with a plurality of activations of the award distributor. The player receives an award for each award symbol indicated in an activation. When a selection group activator symbol is indicated, the gaming device displays or highlights at least one selection set. The gaming device enables the player to pick one selection from the selection set and provides a selection award associated with the picked selection. After the player picks a selection, the selection cannot be picked again from the selection set during the bonus game and therefore, the number of available selections in the selection set decreases by one. Subsequently, when a selection group activator symbol is indicated, the player picks from the remaining available selections in the selection set. In one alternative embodiment, the processor reassigns awards to the selections and the player can subsequently pick any of the selections. This embodiment preferably includes a plurality of selection groups selectively picked by the award distributor. For purposes of this application, one embodiment of the award distributor is an award wheel which is illustrated and described to describe the present invention. It should, however, be appreciated that the award distributor could be any suitable mechanical device or display by a display device.

Figure 3:
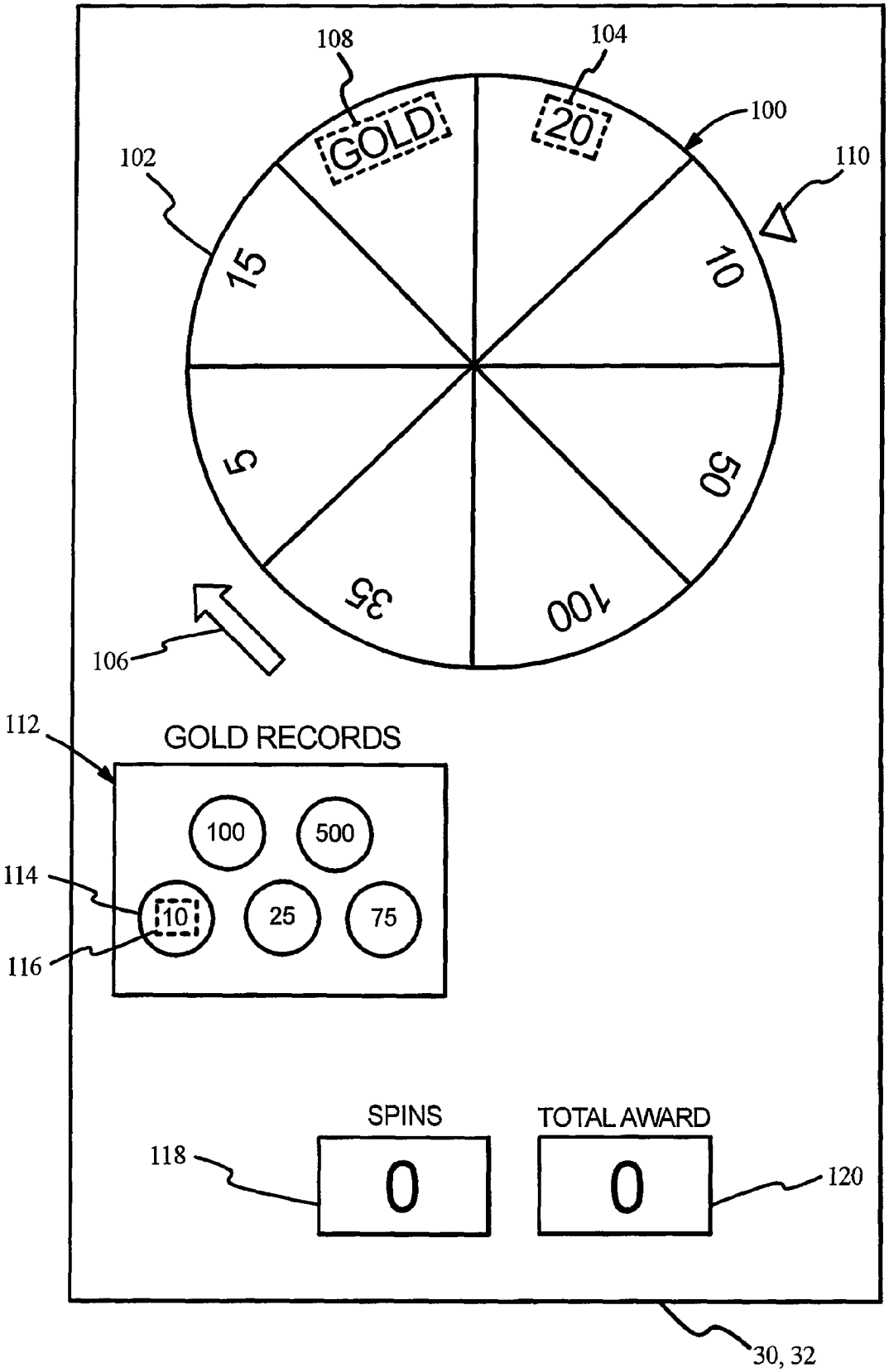
FIG. 3 is an enlarged elevation view of a display device illustrating one embodiment of the present invention wherein the award distributor is an award wheel which has one selection group activator symbol and associated selection set.

Referring now to FIG. 3, one embodiment of the gaming device 10 of the present invention includes an award wheel 100. In one embodiment, the award wheel 100 is displayed on a video display device such as display device 32 illustrated in FIG. 1B. In another embodiment, the award wheel is a mechanical wheel that is physically attached to the gaming device as illustrated in FIG. 1A. The award wheel 100 is divided into or includes a plurality of pie-shaped sections 102. Any suitable number of sections may be employed by the implementer of the gaming device of the present invention. An award or award symbol 104 is on or otherwise associated with each section 102, except for at least one section which includes a selection group activator symbol 108. In one embodiment, a number of bonus credits is associated with each award symbol 104. However, it should be appreciated that an award does not have to be associated with each section and that a multiplier, zero award, negative award or other type of modifier or award may be associated with one or more sections of the award wheel. In operation, the award wheel spins or rotates in a clockwise direction as shown by arrow 106. It should be appreciated that the award wheel can also spin in a counter-clockwise direction if desired. It should also be appreciated that a section indicator which moves to designate or indicate sections could alternatively be employed in the gaming device of the present invention. It should also be appreciated that the award wheel and sections thereof may be different shapes and sizes. For instance, the selection group activator symbol section may be larger than the other sections.

As further discussed below, probabilities are preferably associated with each award symbol or section and each selection group activator symbol. In one embodiment, the processor determines which symbol will be indicated based on the probabilities. The probabilities may be equal, different or weighted in any suitable manner and may change for each activation of the award distributor.

The selection group activator symbol 108 enables a player to play a sub-game or extension game of the primary award wheel bonus game of the present invention. The selection group activator symbol 108 in FIG. 3 is designated by the word "GOLD," however, the selection group activator symbol may be designated by any word, symbol, image or sound desired by the game implementer. When a selection group activator symbol 108 is indicated by section indicator 110, the gaming device prompts the player to pick a selection from a selection set 112. The gaming device may prompt the player by displaying a phrase such as "Pick a Selection," or illuminate the selection set 112. It should be appreciated that any type of prompt or prompting method may be employed to prompt the player to pick a selection from the selection set 112. The player picks a selection from a selection set using a selector. In one embodiment, the display device includes a touch screen, which functions as a selector for enabling the player to pick the selections. In an alternative embodiment, the selector is one or more mechanical or electromechanical buttons or indicators which communicate with the processor and enable the player to pick the selections.

The selection set 112 includes a plurality of selections 114. A selection award 116 is associated with each selection. The gaming device preferably displays the selection set 112 to the player during the duration of the bonus game. In this manner, the player can keep track of the selections that the player has selected in the selection set. The selection set 112, however, may be displayed on a separate display or displayed only when the section indicator 110 indicates the selection group activator symbol.

The selections 114 are associated with selection awards 116 wherein the awards are initially masked or hidden to a player. When a player picks a selection 114, the selection award 116 associated with that selection is revealed to the player. The revealed selection awards remain revealed to the player until the bonus game ends. Preferably, the selection awards are credits, however, it should be appreciated that the selection awards may be free spins, free games, multipliers, zero awards, negative awards or any other type of award desired by the game implementer. The selection set 112 includes a fixed number of selections 114. The selection awards associated with the selections preferably include a range of awards that progressively increase in value from at least one relatively low award value to at least one relatively large award value as shown in the selection set 112 in FIG. 3. The selection set 112, however, may include any fixed number of selections and award values as desired by the game implementer. The selection awards 116 are preferably predetermined by the processor 38 and associated with the selections at the beginning of the bonus game. Alternatively, the selections 114 are associated by the processor with selection awards 116 as the player picks each selection.

The gaming device preferably includes an activation or spin display 118 and a total award display 120. The activation or spin display 118 indicates the number of activations or spins of the award distributor (in this embodiment, the award wheel) that are remaining in the bonus game. The number of spins indicated in spin display 118 decreases by one after each spin by a player. Also, the spin display will reflect any additional spins earned by the player during the bonus game. The total award display 120 indicates the total value of the awards and bonus awards that the player has accumulated at each point during the bonus game. When the player runs out of spins and the bonus game ends, the total award identified in the total award display 120 is transferred to the player's credit display in a conventional manner.

Figure 4:
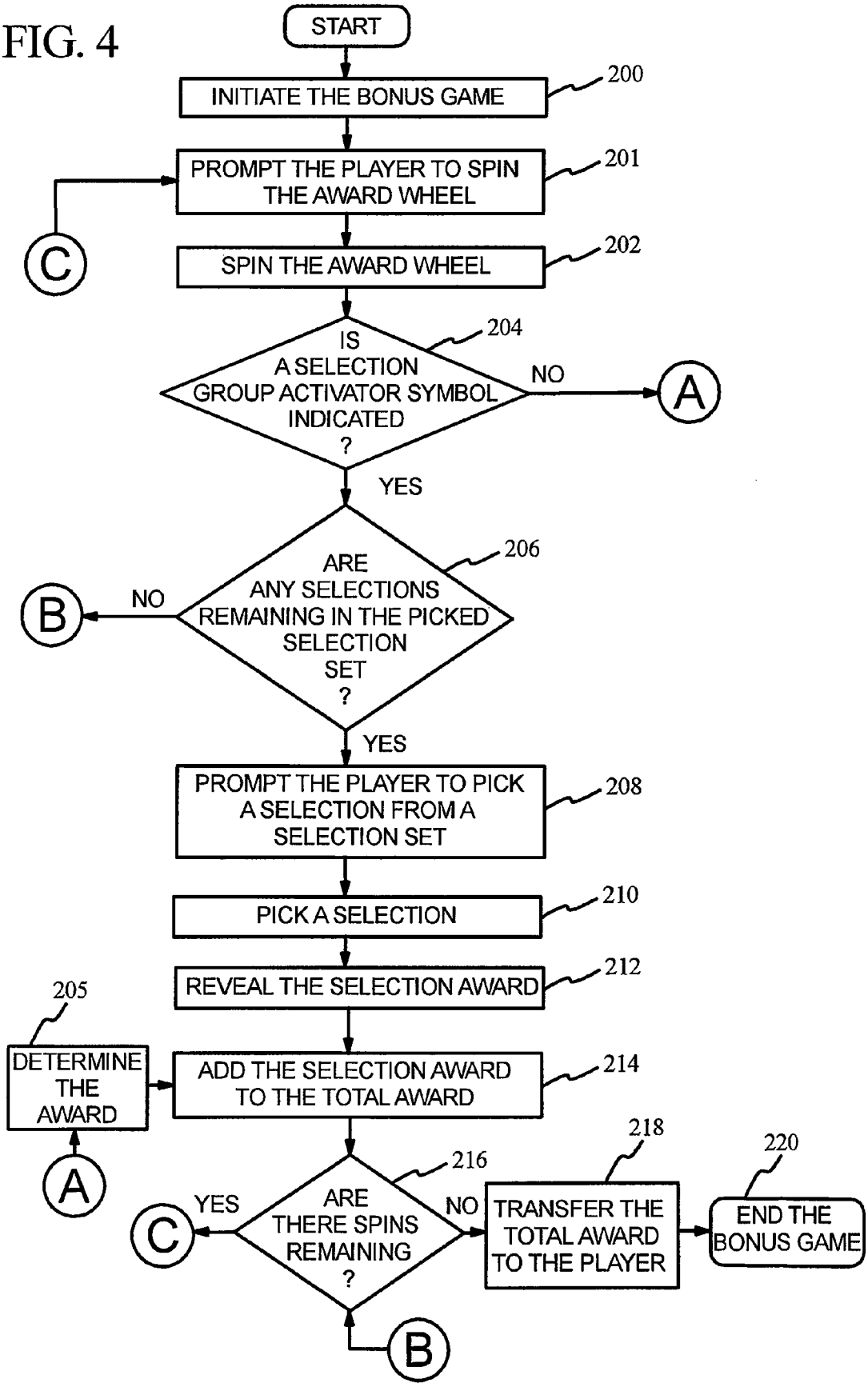
FIG. 4 is a flow diagram of the method of one embodiment of the present invention.

Referring now to FIG. 4, the operation of the bonus game of the present invention is illustrated by a flow diagram. A player initially plays a base game of the gaming device. In a traditional slot machine gaming device, the player spins a plurality of reels including different symbols usually associated with the theme of the particular gaming device. If the player obtains a bonus triggering symbol or symbol combination, the player initiates the bonus game of the gaming device as indicated by block 200.

In one embodiment of present invention, the gaming device prompts the player to spin the award wheel as indicated by block 201. The prompt is a message displayed on the display device 30 or 32 that instructs the player to spin the award wheel using a button. The prompt may also be a flashing button that alerts the player to spin the award wheel. When the player presses the button, the award wheel begins to spin. It should be appreciated that other suitable prompting techniques or devices may be used by the game implementer as desired. It should also be appreciated that the present invention includes spinning the award wheel without player interaction.

After the player activates the award wheel as indicated by block 202, the award wheel rotates or spins in a clockwise direction on the gaming device. When the award wheel stops spinning, the indicator adjacent to the award wheel indicates the section that the player obtained on the wheel. It should be appreciated that the indicator and award wheel are constructed so that the indicator will only point to one section of the award wheel at a time. It should also be appreciated that alternatively the indicator or the indicator and the award wheel could move. The gaming device and, more particularly, the processor 38 determines whether the indicated award wheel section includes an award or a selection group activator symbol as indicated by decision diamond 204. Alternatively, the processor controls which section will be indicated and knows whether the indicated section has an award symbol (and any value associated with the award symbol) or a selection group activator symbol.

If the player obtains an award, the gaming device determines the type of award to provide to the player as indicated by block 205. The award may be bonus values, credits, modifiers such as multipliers, separate bonus games, additional spins in the base game or any other awards or prizes. After determining the award type, the gaming device provides the award to the player and adds the award to the total award as indicated by block 214. The gaming device then determines if any spins are remaining in the bonus game as indicated by decision diamond 216. If there are no spins remaining in the bonus game, the gaming device transfers the total award to the player as indicated by block 218. If there are spins remaining in the bonus game, the gaming device prompts the player to spin the award wheel again as indicated by block 201.

If the gaming device determines that a selection group activator symbol is indicated by the section indicator in decision diamond 204, the gaming device determines if there are any selections remaining in the selection set as indicated by decision diamond 206. Preferably, if there are no selections remaining in the selection set, the player does not receive an award and is prompted to spin the award wheel again as indicated by block 201 without decrementing the spin meter or counter 118. If there is at least one selection remaining in the selection set, the gaming device prompts the player to pick a selection from a selection set a indicated by block 208. The player preferably picks one selection from the selection set as indicated by block 210. The gaming device reveals the selection award associated with that selection as indicated by block 212. The selection award is added to the player's total award in the bonus game as indicated by block 214.

The gaming device determines if there are any spins remaining in the bonus game as indicated by decision diamond 216. If there are no spins remaining in the bonus game, the gaming device transfers the total award accumulated in the bonus game to the player as indicated by block 218. After the total award is transferred, the bonus game ends as indicated by oval 220. If there are spins remaining in the bonus game, the gaming device prompts the player to spin the award wheel again as indicated by block 201. After the player spins the award wheel as indicated by block 202, the gaming device again determines if a selection group activator symbol is indicated by the section indicator as indicated by decision diamond 204. The process described above repeats until there are no spins remaining in the bonus game.

Referring to FIG. 3, in one embodiment of the present invention, the gaming device 10 eliminates or does not allow the selection 114 to be subsequently picked from the selection set 112 after that selection has been picked by a player. As a result, a reduced number of available selections 114 are selectable in selection set 112 after each pick by the player. Furthermore, the selection award 116 is preferably not duplicated in a bonus game. Thus, the player's chances of picking a selection 114 having a desired selection award 116 increases after each picked selection that does not reveal the desired selection award because there are less available selections to pick from in the selection set. Therefore, the player's excitement and enjoyment of the bonus game increases after each pick because the probability or odds of obtaining a specific selection award increases after each pick. Also, after a player picks a selection and the selection is eliminated, the selection award associated with the picked selection remains viewable by the player until the bonus game ends. The selection awards remain viewable so that a player may keep track of the selection awards that the player has obtained in the bonus game. Therefore, the viewable selection awards may further increase the players' excitement level because the player knows which bonus awards remain in a selection set.

Figure 5A:
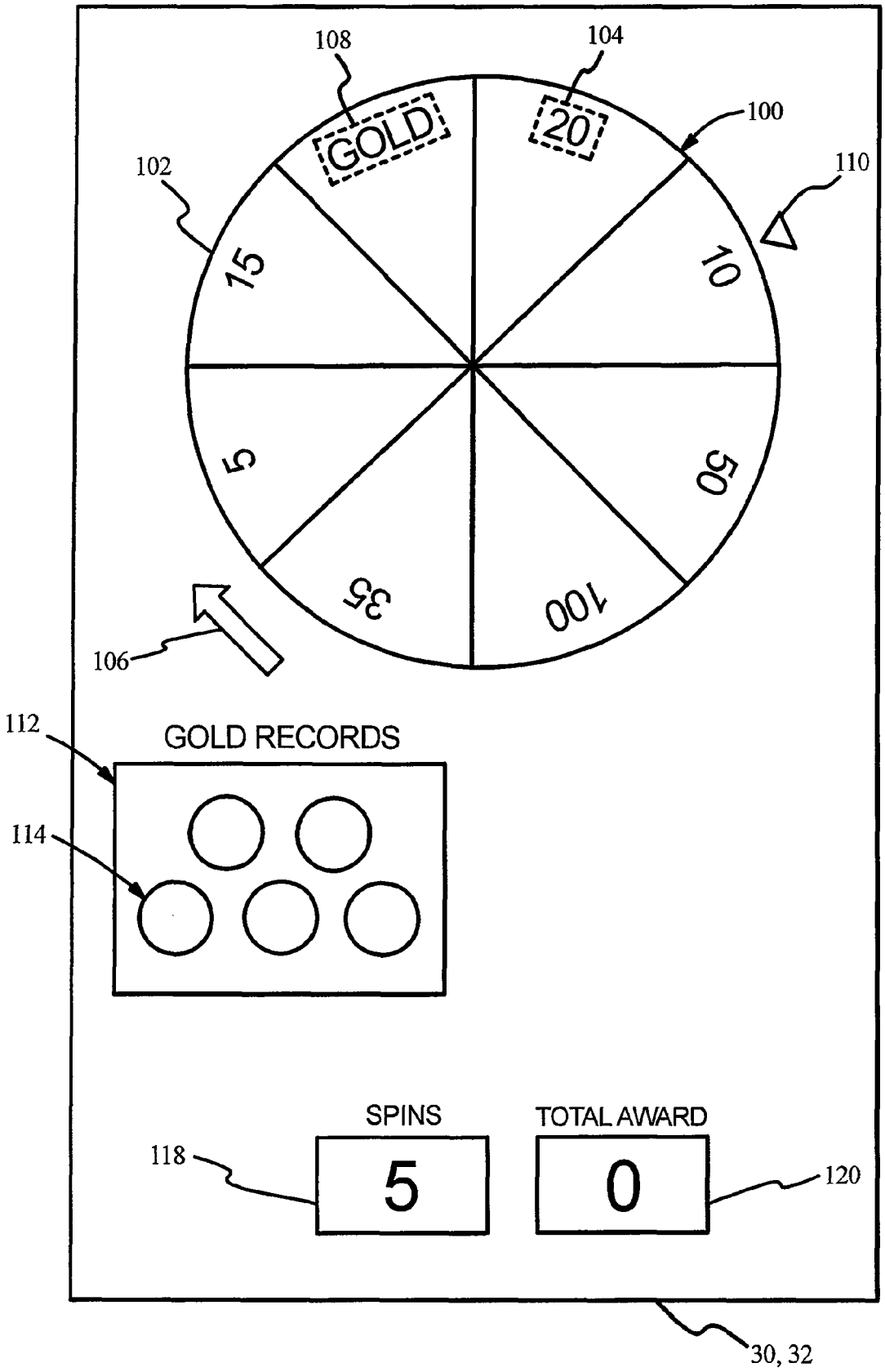
FIGS. 5A to 5F are enlarged elevation views of a display device illustrating an example of an embodiment having one selection group activator symbol where a player activates or spins the award distributor in the form of an award wheel five times in a bonus game.

Referring now to FIGS. 5A through 5F, an example of one embodiment of the present invention is illustrated where the player spins the award wheel 100 five times in the bonus game. As shown in FIG. 5A, the award wheel 100 has several sections 102, one including a selection group activator symbol 108 designated by the word "Gold" and a plurality of selections associated with award values 104. A selection set 112 having a plurality of masked selections 114 is associated with the selection group activator symbol 108. If a selection group activator symbol 108 is indicated by the section indicator 110, the gaming device will prompt the player to pick one selection from the selection set 112. The picked selection 114 reveals a selection award that will remain viewable by the player until the bonus game ends. The picked selection and associated selection award are no longer available to be selected in the selection set. Therefore, the player will only pick from the remaining available selections in the selection set when a selection group activator symbol is indicated in subsequent spins or activations. In this example, the spin display 118 indicates that the player has five spins in the bonus game. Also, the player does not begin the game with any awards as indicated by the total award display 120.

Figure 5B:
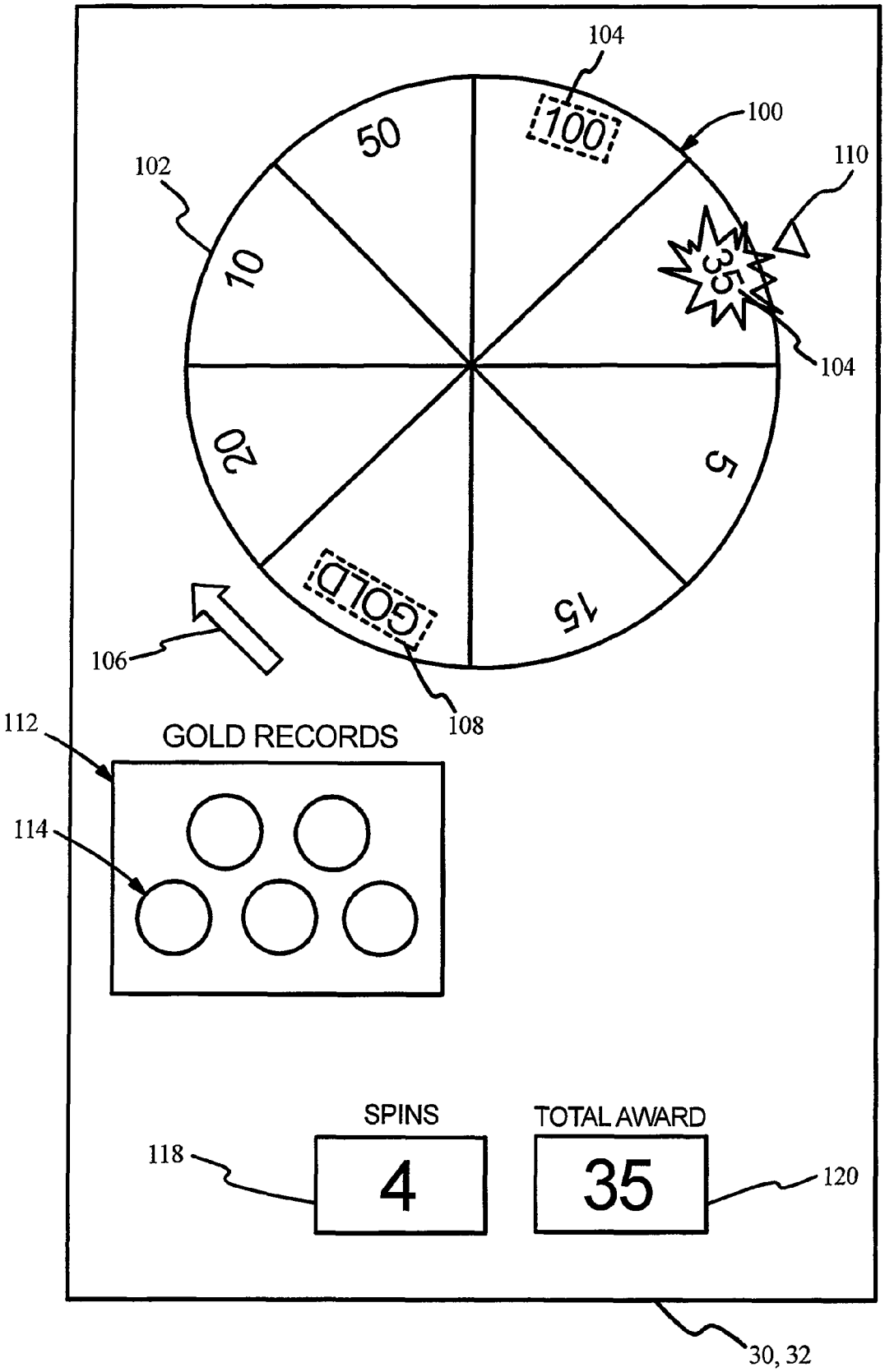

In FIG. 5B, the player begins the game by spinning the award wheel 100. The award wheel 100 spins in a clockwise direction as shown by arrow 106. After the award wheel 100 stops spinning, the section indicator 110 indicates the section 102 obtained by the player. The indicated section is associated with an award value of thirty-five. Therefore, after the first spin, the award value of thirty-five is added to the total bonus award as displayed in the award display 120. Since this spin was the player's first spin in the bonus game, the player's total award equals the value of the award obtained after the first spin, which is thirty-five. Any awards that the player obtains in subsequent spins will be added to this total award shown in award display 120.

Figure 5C:
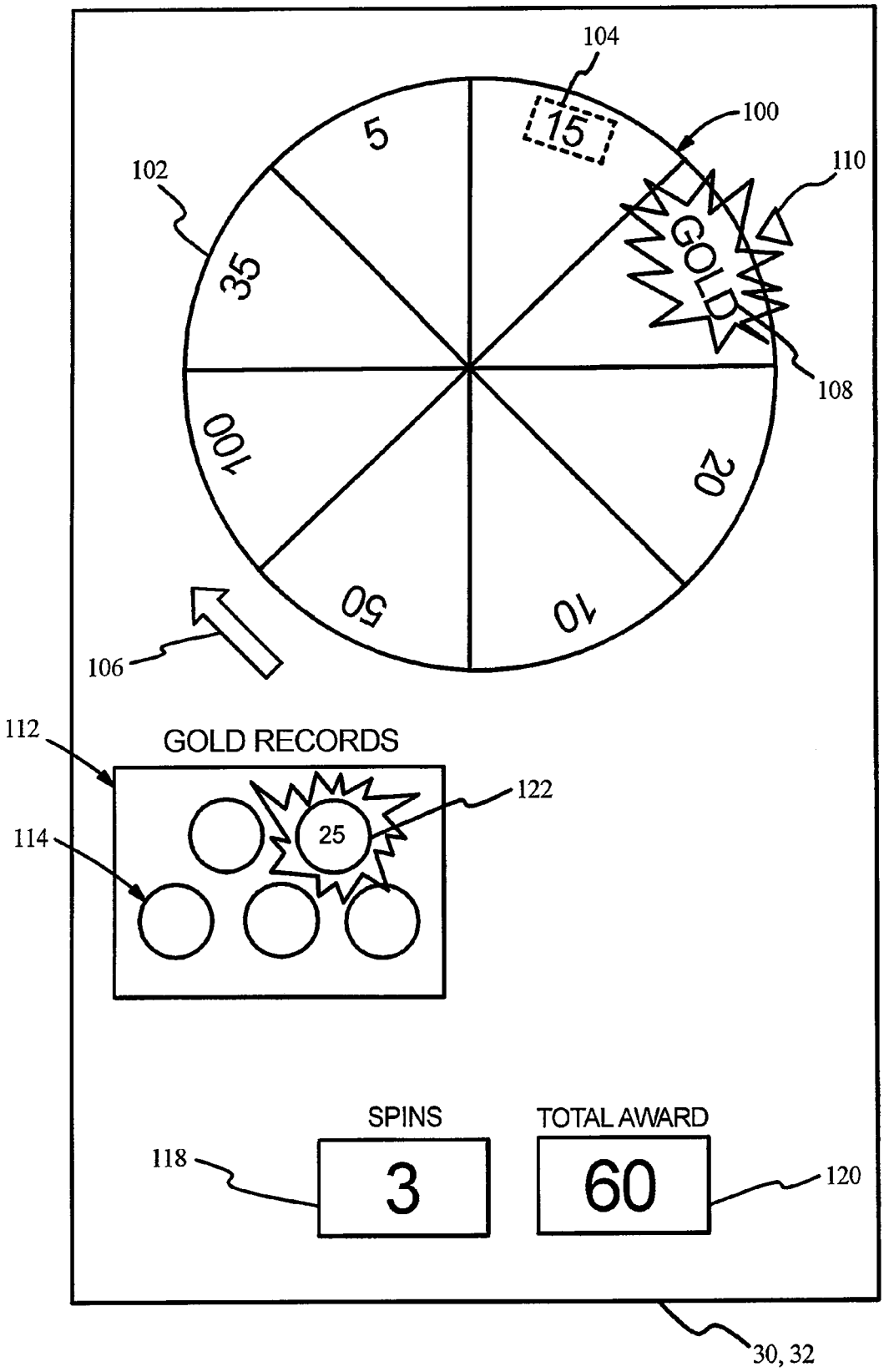

Since the player still has spins remaining in the bonus game, the gaming device prompts and enables the player to spin the award wheel 100 again. In FIG. 5C, the player spins the award wheel for the second time in the bonus game. After this spin, the indicator 110 indicates a section 102 that includes a selection group activator symbol 108, which is designated with the word "GOLD." The selection group activator symbol 108 is linked or associated with selection set 112, which includes a plurality of masked selections 114. In this example, the selection set 112 is titled "Gold Records" and the plurality of selections 114 represent records having various album or song titles. It should be appreciated that any theme or subject may be used for the selection group activator symbol, selection set and selections. Because the section indicator 110 indicates a selection group activator symbol, the gaming device prompts the player to pick one selection 114 from the selection set 112. The player picks selection 122 from the selection set, which reveals an associated selection award of twenty-five. The selection award value of twenty-five is added to the total award of thirty-five to achieve the new total award of sixty as indicated in total award display 120. The bonus award associated with picked selection 122 remains viewable by the player for the remainder of the bonus game. However, selection 122 is eliminated from the selection set 112 so that the player may only pick from the remaining available masked selections 114, excluding revealed selection 122, if the player obtains another selection group activator symbol during this bonus game. The player has three spins remaining in the bonus game as indicated by the spin display 118.

Figure 5D:
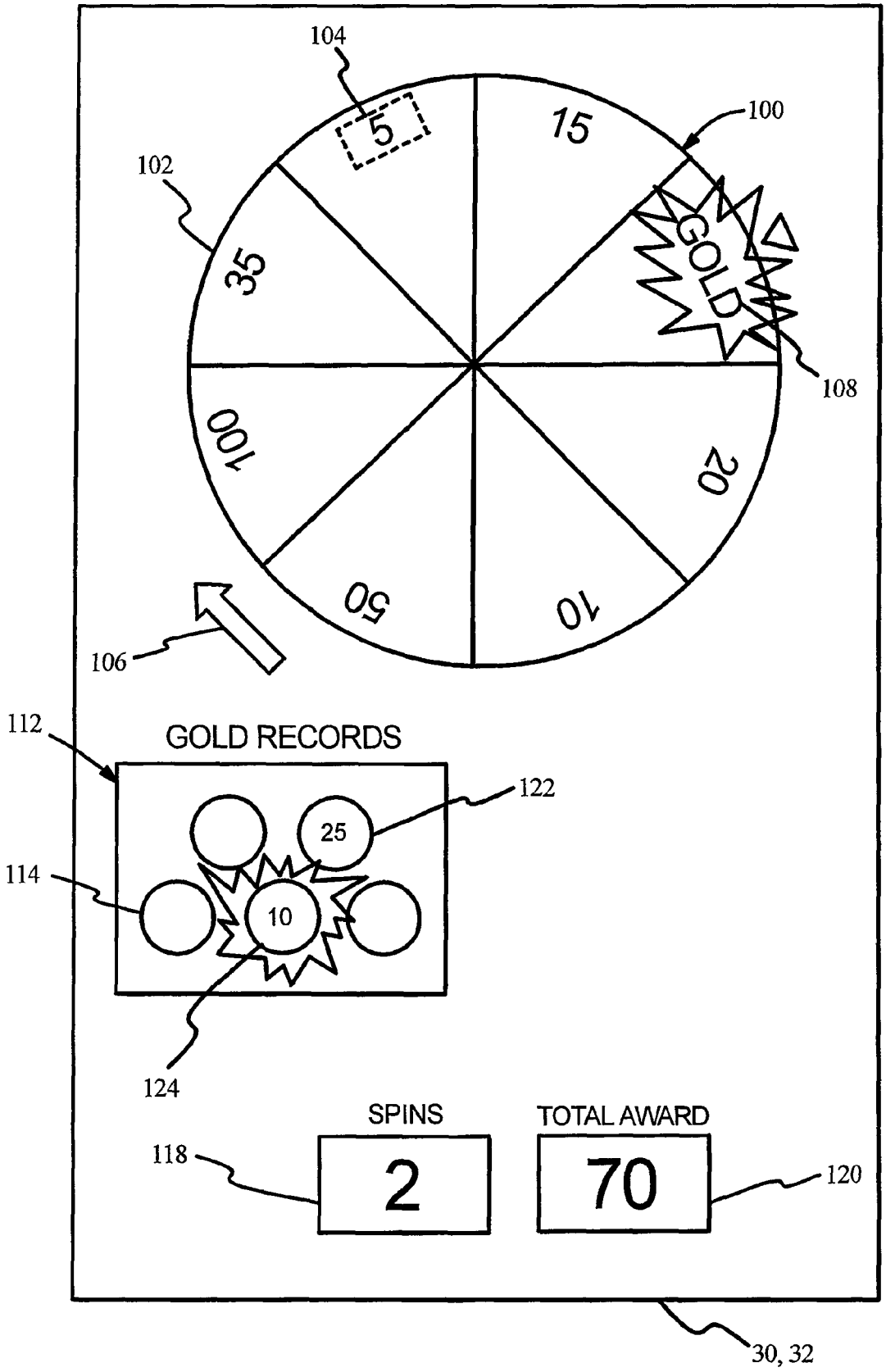

Referring to FIG. 5D, the player spins the award wheel 100 for the third time in the bonus game. Again, the section indicator 110 indicates a selection group activator symbol 108 on the award wheel. Therefore, the player picks one selection from the remaining selections 114 in the selection set 112. The player picks selection 124, which reveals a selection award of ten. The award, ten, is added to the player's total award of sixty. The new total award in the bonus game is seventy as indicated by the total award display 120. The picked selection 124 is eliminated from the selections 114. The player may only pick from the remaining available selections 114 in selection set 112, which excludes previously picked selections 122 and 124. The probability that the player will pick a larger selection award on the player's next pick in the selection set 112 is greater than in previous picks because there are only three remaining selections 114 in the set. The player has two spins remaining in the bonus game as indicated by the spin display 118.

Figure 5E:
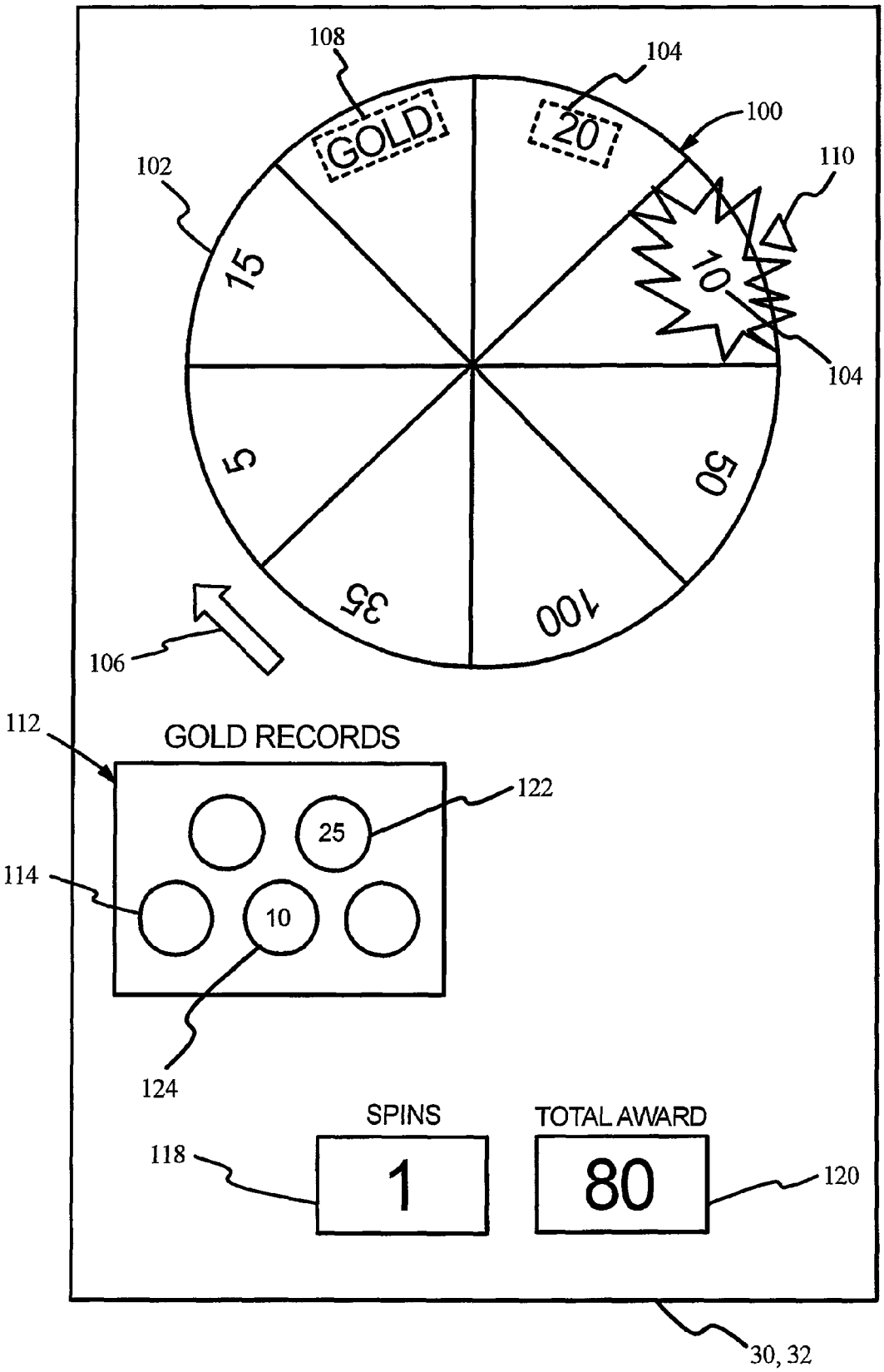

Referring to FIG. 5E, the player spins the award wheel 100 for the fourth time in the bonus game. After the wheel stops spinning, an award of ten is indicated by the section indicator 110. The award, ten, is added to the player's total award of seventy to achieve a new total award of eighty as indicated by the total award display 120. The player has one spin remaining in the bonus game as indicated by the spin display 118.

Figure 5F:
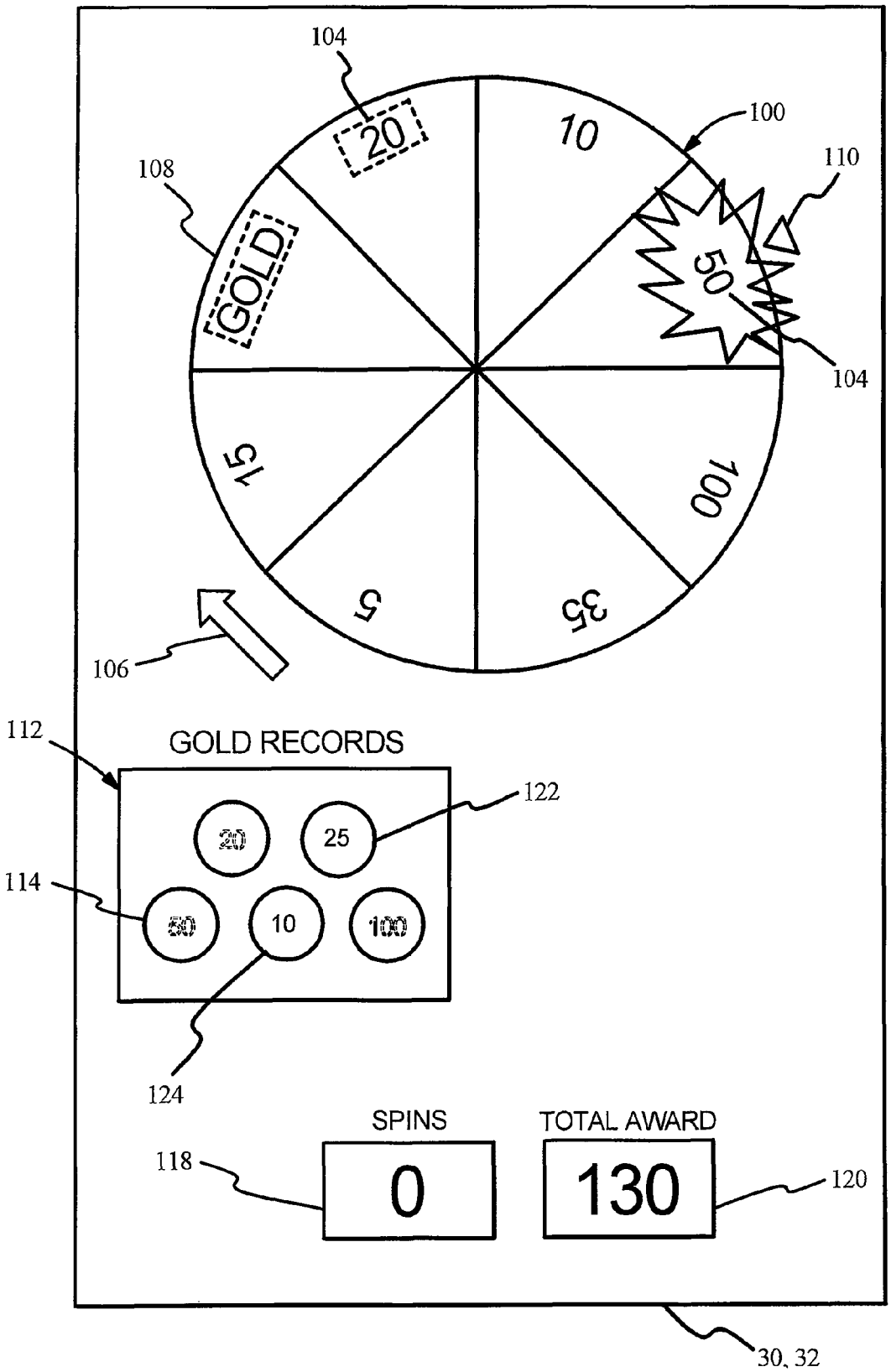

Referring to FIG. 5F, the player spins the award wheel 100 for the fifth and final time in the bonus game. An award of fifty is indicated by the section indicator 110. The award, fifty, is added to the player total award of eighty to achieve a new total award of one hundred thirty as indicated by the total award display 120. There are no spins remaining in the bonus game and therefore the player receives the total award for the bonus game. As also indicated in phantom in FIG. 5F, the other awards associated with the selections may be revealed by the display device.

Figure 6A:
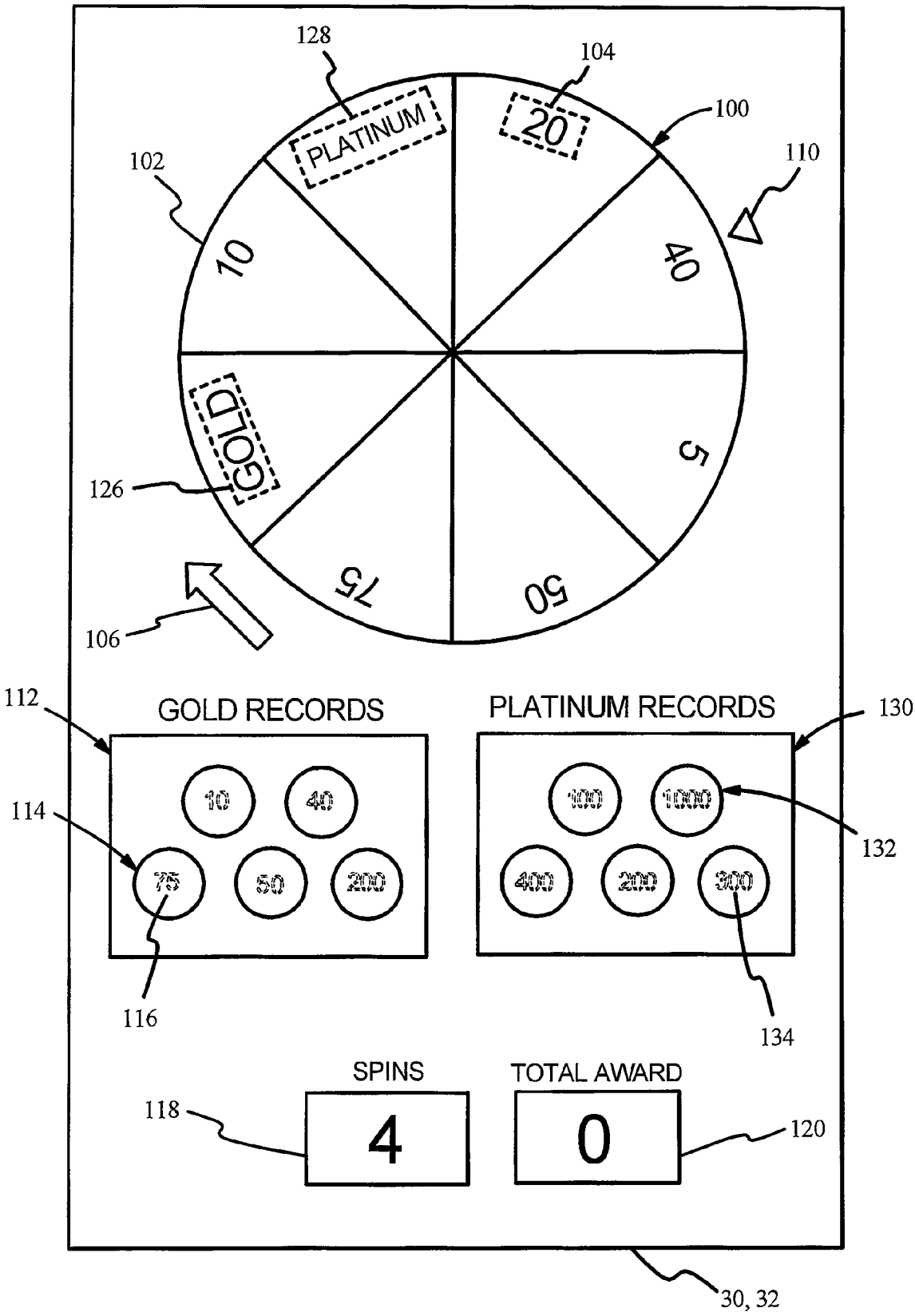
FIGS. 6A to 6E are enlarged elevation views of a display device illustrating an example of another embodiment of the present invention having two selection group activator symbols where a player activates or spins the award distributor in the form of an award wheel four times in a bonus game.

Referring now to FIGS. 6A through 6E, another embodiment of the present invention is illustrated where the bonus game includes a plurality of selection group activator symbols and selection sets. Referring to FIG. 6A, the award wheel 100 includes two selection group activator symbols 126 and 128, respectively, wherein one selection group activator symbol 126 is designated with the word "GOLD" and the other 128 is designated with the word "PLATINUM." Selection group activator symbol 126 links the player to the "GOLD RECORDS" selection set 112 and selection group activator symbol 128 links the player to the "PLATINUM RECORDS" selection set 130. Selection set 112 includes five selections 114, which are associated with masked selection awards 116 (shown in phantom). Selection set 130 includes five selections 132, which are associated with masked selection awards 134 (shown in phantom). In this example, the selection awards associated with selection set 114 have relatively small award values (i.e., 10, 40, 50, 75 and 200) and the selection awards associated with selection set 130 have relatively large award values (i.e., 100, 200, 300, 400 and 1000). Therefore, in this example, the player desires to pick selections in selection set 130 because this selection set has selection awards with larger values. The player begins the bonus game with four spins as indicated by spin display 118, and a total award of zero as indicated by total award display 120.

Figure 6B:
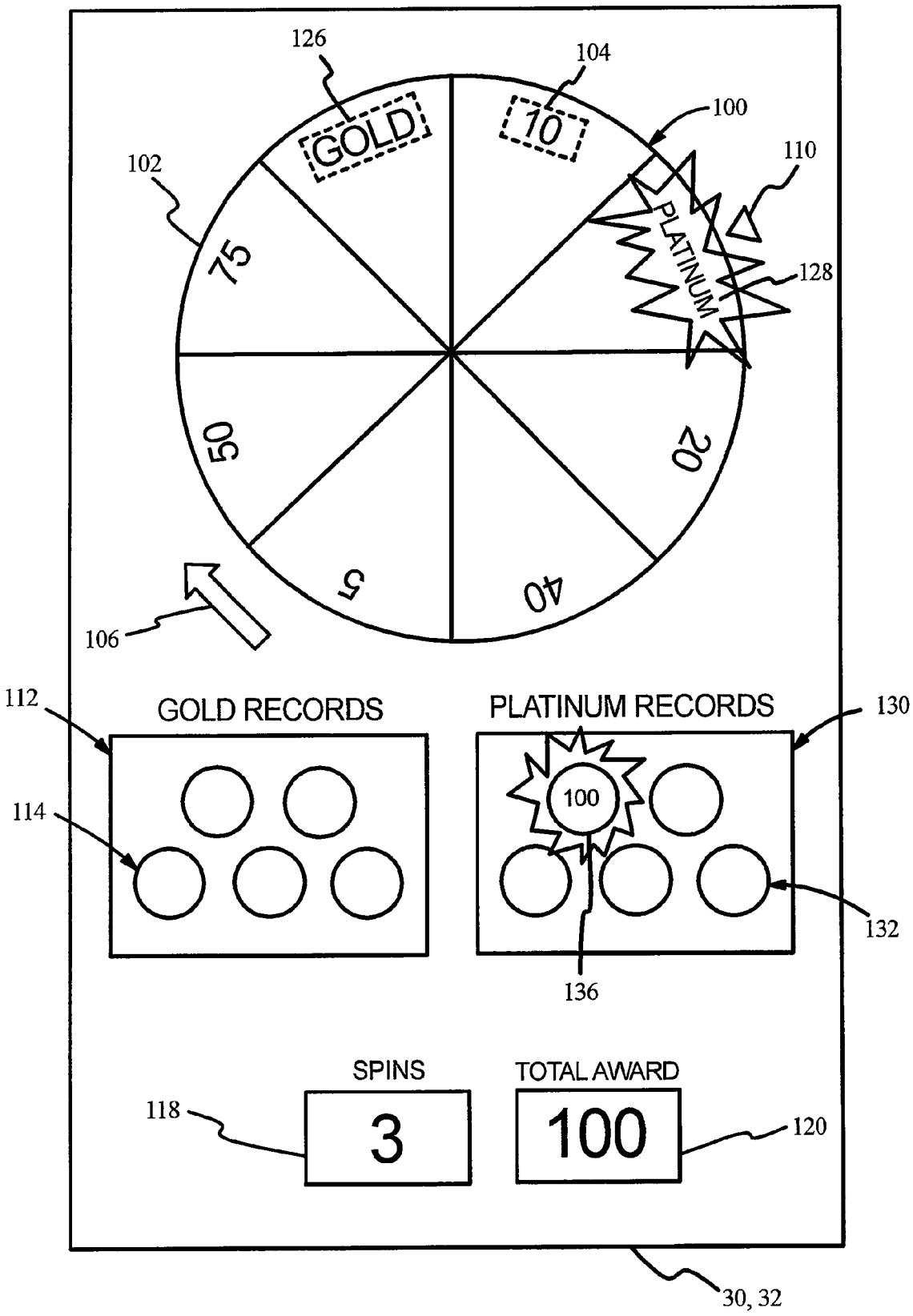

Referring to FIG. 6B, the player spins the award wheel for the first time in the bonus game. The section indicator 110 indicates selection group activator symbol 128, which is associated or linked to selection set 130. The player's level of excitement increases because selection set 130 includes selections 136 that have relatively larger selection awards than the selection awards in selection set 112. The player picks selection 136 from the selection set, which reveals a selection award of one hundred. The selection award is added to the player's current award total of zero to achieve a new total award of one hundred as indicated by the total award display 120. The award associated with picked selection 136 remains viewable to the player, but the picked selection 136 is eliminated from the selection set 130. Selection set 130 now has only four available selections remaining and therefore the player has an improved chance to obtain a larger selection award in this selection set. The player has three spins remaining in the bonus game as indicated by the spin display 118.

Figure 6C:
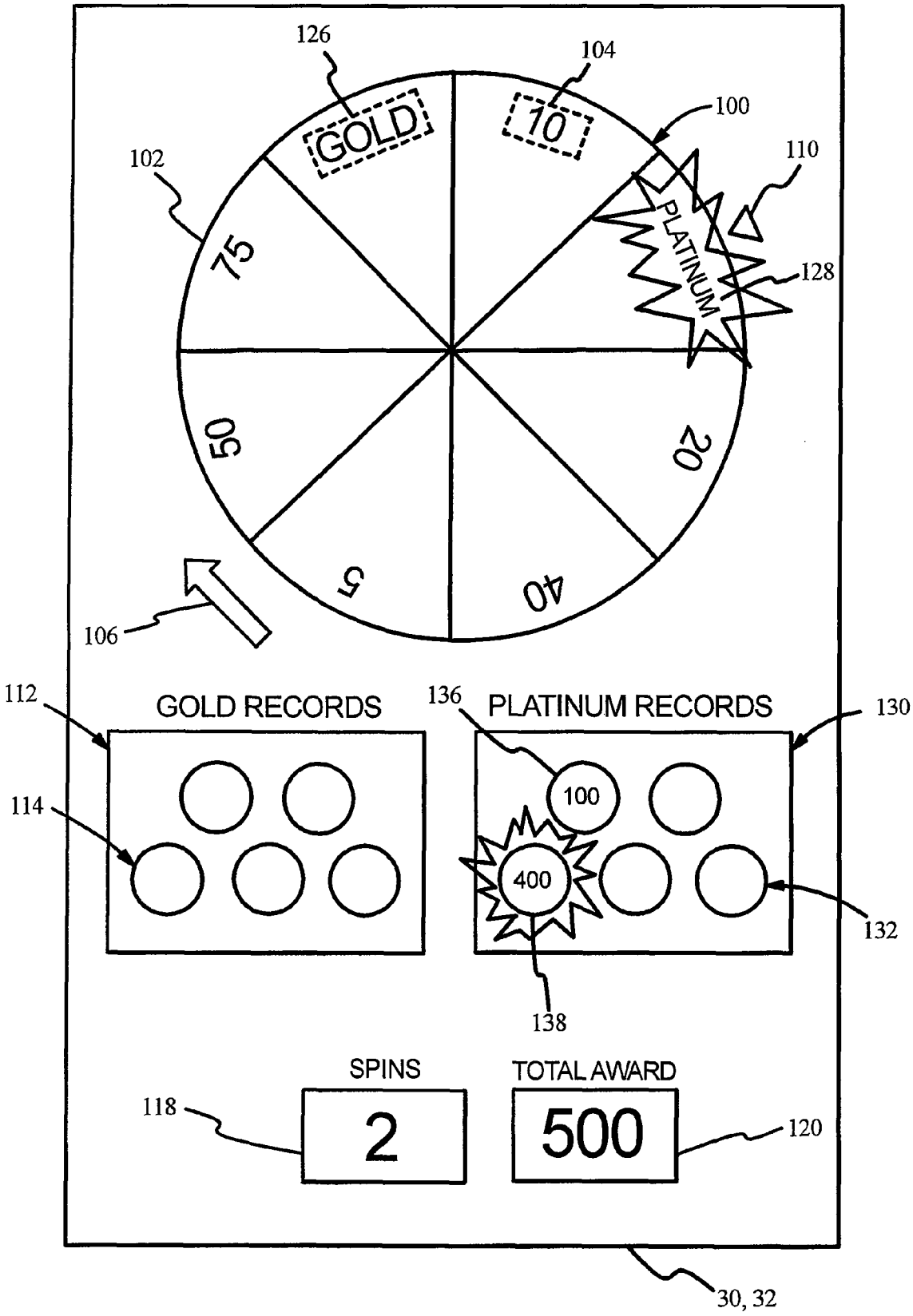

Referring to FIG. 6C, the player spins the award wheel 100 for the second time in the bonus game. Again, the section indicator 110 indicates selection group activator symbol 128. The player picks another selection, selection 138, from the selection set, which reveals a selection award of four hundred. The selection award of four hundred is added to the player's total award to achieve a new total award of five hundred as indicated by the total award display 120. The second picked selection in selection set 130 remains viewable and is eliminated from the selection set. There are three remaining available selections 132 in selection set 130. The player has two spins remaining in the bonus game as indicated by spin display 118.

Figure 6D:
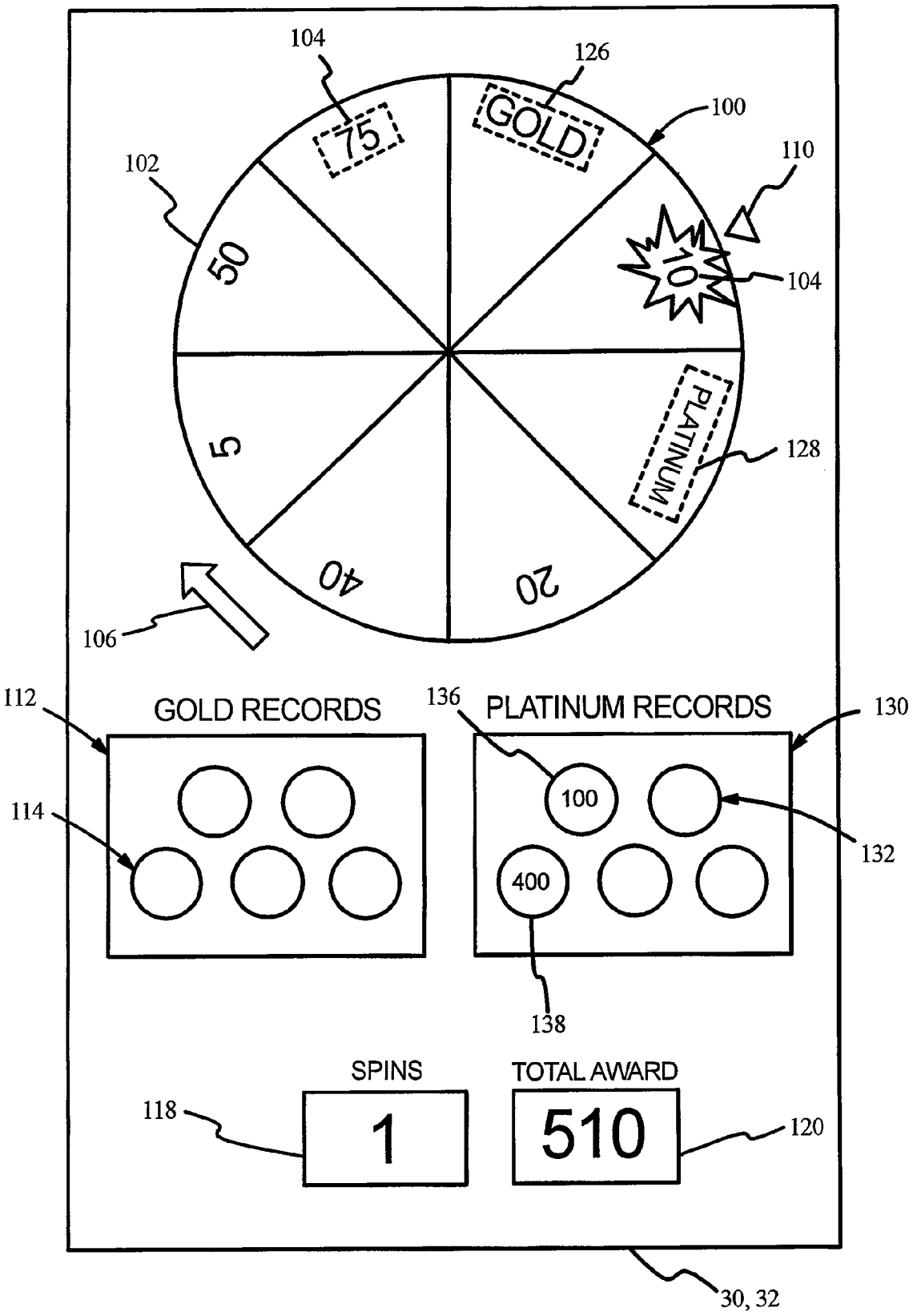

Referring to FIG. 6D, the player spins the award wheel 100 for the third time in the bonus game. The section indicator 110 indicates an award of ten. The indicated award, ten, is added to the player's total award. The total award for the bonus game is now five hundred ten as indicated by total award display 120. The player has one spin remaining in the bonus game as indicated by spin display 118.

Figure 6E:
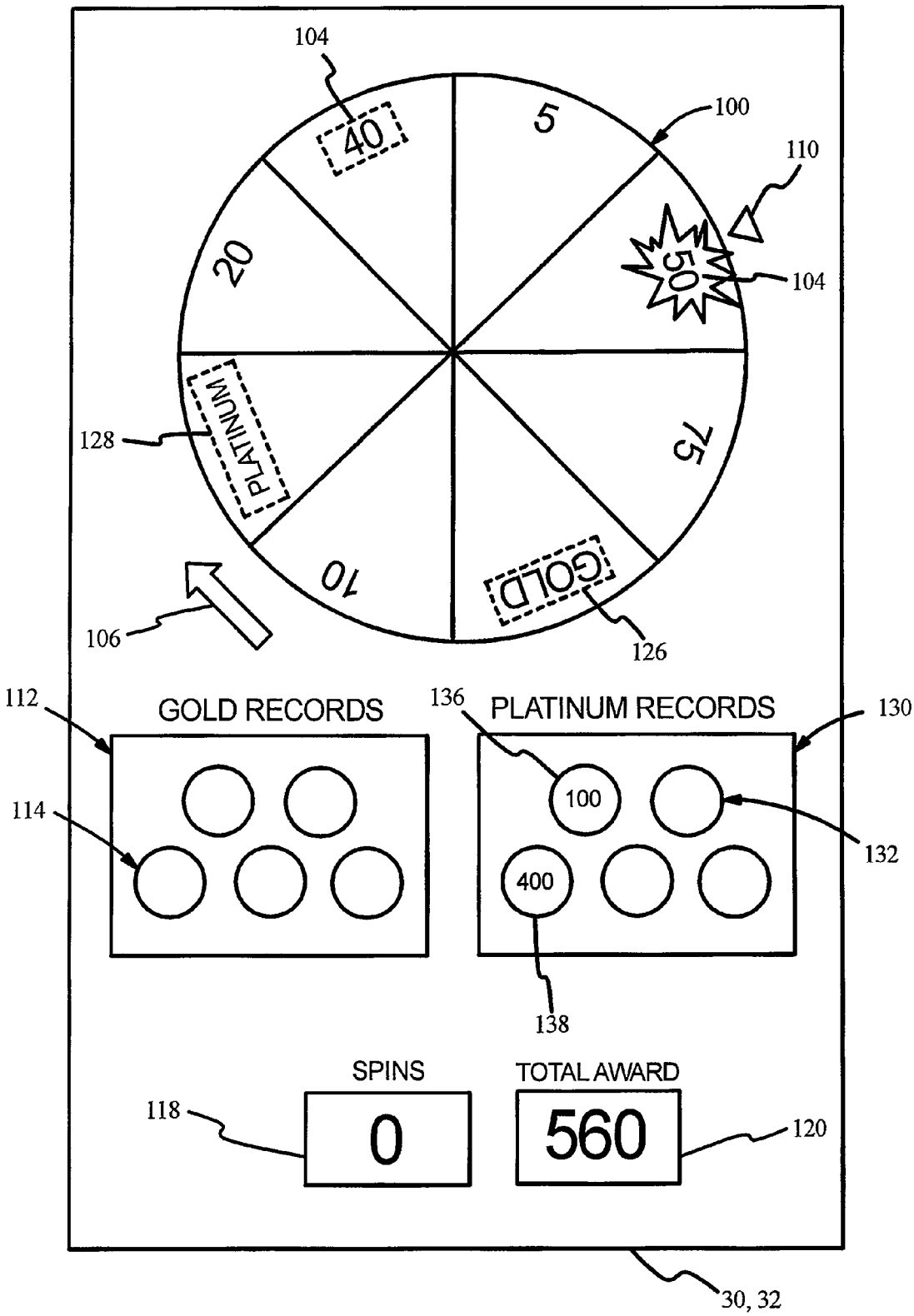

Referring to FIG. 6E, the player spins the award wheel 100 for the fourth and final time in the bonus game. The section indicator indicates an award of fifty, which is added to the player's total award of five hundred ten. The final total award is five hundred sixty. Because the player has no spins remaining in the bonus game, the gaming device provides the total award indicated in total award display 120 to the player.

In a further embodiment of the present invention, the gaming device includes an award wheel having one selection group activator symbol 108 and a plurality of selection sets 112. When a selection group activator symbol 108 is indicated by the award wheel, the gaming device randomly provides or highlights one of the selection sets 112 to the player. The player then picks one of the selections from the designated selection set and the bonus game proceeds as described above. In this embodiment, the selection sets 112 are associated with probabilities of being provided by the gaming device such that the probability of one selection set being provided to a player is greater than the probability of another selection set being provided to the player. In another embodiment, the probabilities are equal so that each selection set has an equal probability of being provided to a player. In a further embodiment, the award distributor includes a selection group activator which activates both of the or multiple selection sets. In such case, the player successively picks from each selection set.

As indicated above, because there are several different sections 102 including a plurality of awards 104 and a selection group activator symbol 108, the sections 102 are preferably associated with probabilities or weighted such that one section is more likely than another section. In one embodiment, the sections are equally weighted or associated with equal probabilities. For example, if an award wheel has twenty sections, a player has a 1/20 or 5% chance of obtaining any one of the sections. Therefore in this embodiment, a player's chances of obtaining any single award section is equal to the chance of obtaining the selection group activator symbol.

In another embodiment, the probabilities change after each spin of the award wheel. Thus, sections on the award wheel start a bonus game having predetermined probabilities and then the probabilities change after each spin by a player. For example, at the beginning of a bonus game the player has a 5% chance of obtaining any section on an award wheel having twenty sections. After the player's first spin, the player receives an award. The processor alters the probabilities so that the player has a 10% chance of obtaining the selection group activator symbol and approximately a 4.74% chance of obtaining any other section on the wheel. Thereafter, the probabilities continue to change after each subsequent spin by the player. It should appreciated that the probability of the selection group activator symbol may decrease and the probabilities of the awards may increase after a spin, or the awards and selection group activator symbol may alternately increase and decrease after each spin or change according to whatever probability scheme is desired by the game implementer. It should also be appreciated that the section probabilities may change after the first spin only and remain the same the rest of the bonus game or change after any number of spins desired.

In another embodiment, the section probabilities change after a predetermined number of spins of the award wheel. In this embodiment, the implementer sets the probabilities to change after a certain number of spins so that a section having a selection group activator symbol is less likely or a section having a large award is less likely the further the player goes into a bonus game. By adjusting the section probabilities in this manner, the game implementer limits the award amounts that the gaming device pays to players. It also limits the likelihood that a player will obtain the one substantially large award on a spin of the award wheel or in a selection set.

For example, an award wheel has twenty sections and a player starts the bonus game with a 5% probability of obtaining each section on the wheel. Before the fourth spin of the award wheel, the section probabilities are programmed to change so that there is a 1% chance of obtaining the selection group activator symbol and approximately a 5.21% chance of obtaining each award section. Now the player is less likely to obtain the selection group activator symbol section with each subsequent spin than any single award section.

A bonus game could be programmed to increase the probability of obtaining a large award section or a selection group activator symbol after a certain number of spins. Therefore, if a player has not obtained a large award section or selection group activator symbol after a number of spins, the gaming device can increase the possibility of obtaining the large award section or selection group activator symbol. For example, an award wheel having ten sections, including one selection group activator symbol section and one large award section, starts a bonus game where a player has an equal probability (i.e. 10%) of obtaining each section on the award wheel. The gaming device is programmed to increase the probability of obtaining both the large award section and the selection group activator symbol after five spins to 15% for each of these sections. Therefore, after five successful spins of the award wheel, the probability of obtaining the large award section or the selection group activator symbol section increases to 15% and the probabilities of obtaining any one of the other eight sections decreases to 8.75%.

In a further embodiment, total awards or award payouts in a bonus game are associated with probabilities. In this embodiment, the processor of the gaming device is programmed so that higher awards are less likely than lesser awards, or vice versa, in a bonus game. Therefore the game implementer controls the award amounts that are paid out by the gaming device without affecting the player's excitement and enjoyment of playing the game. For example, a processor is programmed to award values of zero through fifty in 60% of the bonus games, 51 through 100 in 30% of the bonus games and over 100 in only 10% of the bonus games in a particular gaming device. Based on the probabilities, the processor picks a total award value for the bonus game and subsequently determines the number of spins and the award amounts for each spin for the game. Thus, the total award is predetermined before the game ever starts, yet the player plays the bonus game as if the award is still to be determined.

In still a further embodiment of the present invention, the selection awards associated with the selections in a selection set or sets are associated with a selection after the selection is picked. In this embodiment, the selections in each selection set are associated with probabilities such that the probability of a larger selection award being associated with a picked selection is less likely than a lower award being associated with the same picked selection. Alternatively, the probability of a larger selection award being associated with a picked selection may be more likely than a lower selection award based on the desire of the game implementer. In an alternative embodiment, the selection awards are randomly associated with the selections in a selection set at the beginning of a bonus game and the probabilities of the lower awards being associated with the selections may be greater or less than the larger awards being associated with the same selections.

In each of the above embodiments, the players always have an opportunity or chance or the appearance of an opportunity or chance to obtain each section on the award wheel whether the section includes a selection group activator symbol or an award. Similarly, the player always has an opportunity or the appearance of an opportunity to obtain each selection in a selection set. Therefore, although the probabilities may change in a bonus game, the players maintain their excitement and enjoyment of the bonus game.

Figure 7A:
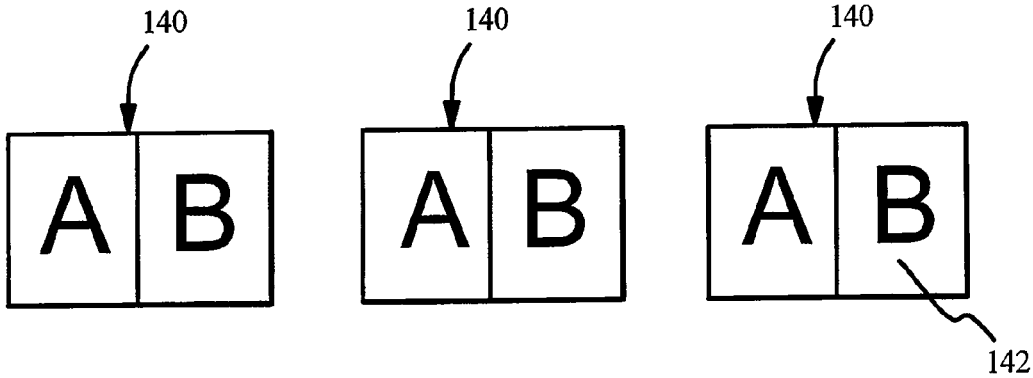
FIGS. 7A and 7B are enlarged elevation views of one embodiment of the present invention where a player obtains additional activations or spins at the beginning of a bonus game by picking one symbol from each group of choices.
Figure 7B:
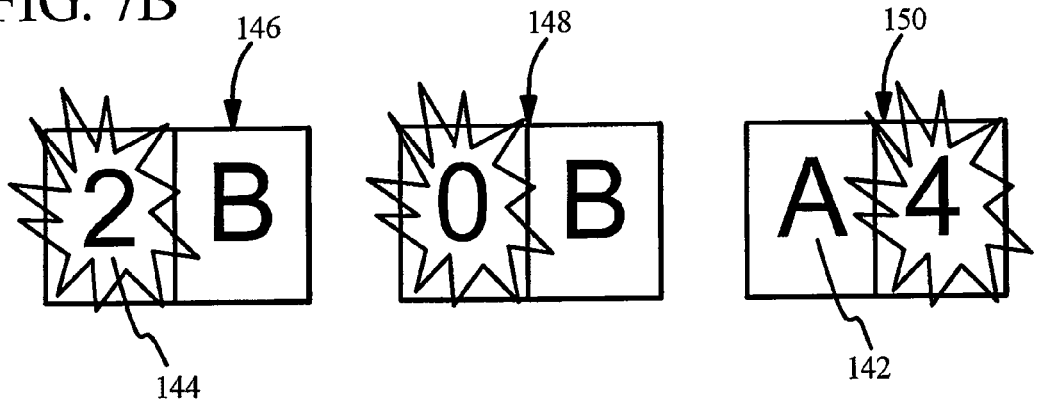

Referring now to FIGS. 7A and 7B, another embodiment of the present invention is illustrated where the player can obtain additional spins at the beginning of a bonus game. A prompt may appear in each bonus game enabling a player to obtain additional spins or the gaming device may randomly determine when to provide the player with the opportunity to obtain additional spins. In one aspect of this embodiment, the gaming device displays at least one additional spin selection set 140 including selections 142. Each selection 142 has an associated additional spin award 144. The player preferably picks one selection 142 from each additional spin selection set 140 until there are no selection sets remaining. The player obtains the amount of additional spins associated with each picked selection. The additional spins awards 144 associated with each selection 142 may include any number of additional spins, including zero spins or negative spin amounts. The player receives the total of the additional spin awards 144 associated with the picked selections.

In FIG. 7B, an example is illustrated where a player picks a selection from three additional spin selection sets 146, 148 and 150. The picked selection in the first selection set 146 reveals two additional spins. The picked selection in the second selection set 148 reveals zero additional spins and the picked selection in the third selection set reveals four additional spins. Therefore, the player obtained six additional spins which will be added to the player's total number of spins provided to the player in the beginning of the bonus game.

Figure 8A:
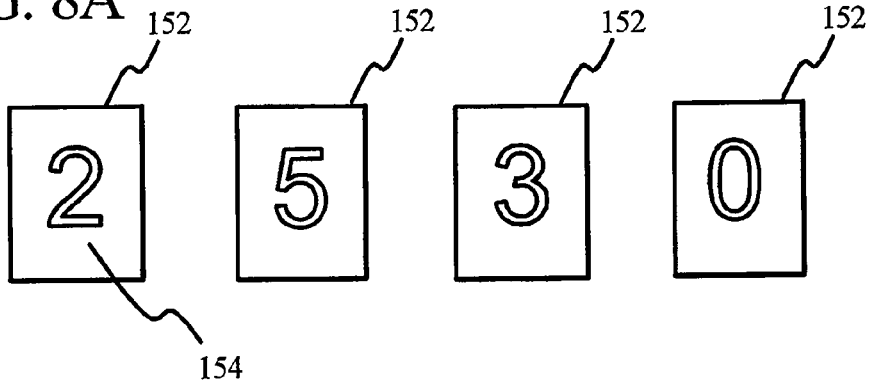
FIGS. 8A and 8B are enlarged elevation views of one embodiment of the present invention where a player obtains additional activations or spins at the beginning of a bonus game by picking one symbol from a plurality of masked choices.
Figure 8B:
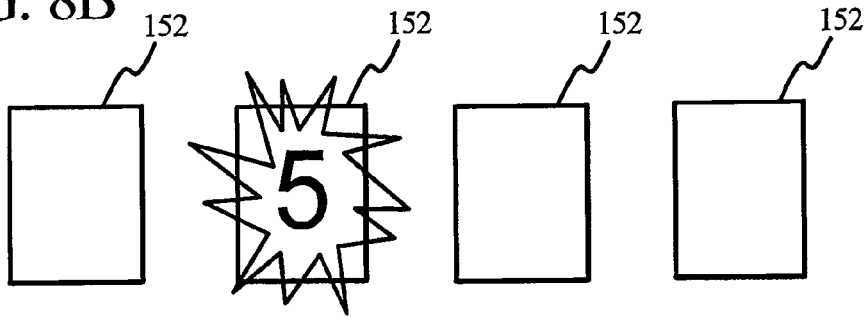

Referring now to FIGS. 8A and 8B, another embodiment of the present invention is illustrated where a plurality of masked selections are displayed to a player at the beginning of a bonus game. Each of the masked selections include an additional spin award 154. The player picks one of the selections 152 and receives the additional spin award 154 associated with the picked selection. The number of additional spins revealed by the picked selection is added to the player's total number of additional spins at the beginning of the bonus game.

In FIG. 8B, the gaming device displays four masked selections 152 to the player at the beginning of the bonus game. The player picks one selection which reveals an additional spin award of five. Therefore, five additional spins are added to the player's total number of spins at the beginning of the bonus game. In each of these embodiments where the player can add spins at the beginning of the bonus game, the player's excitement level increases because the player receives additional opportunities to obtain more awards in the bonus game.

Figure 9:
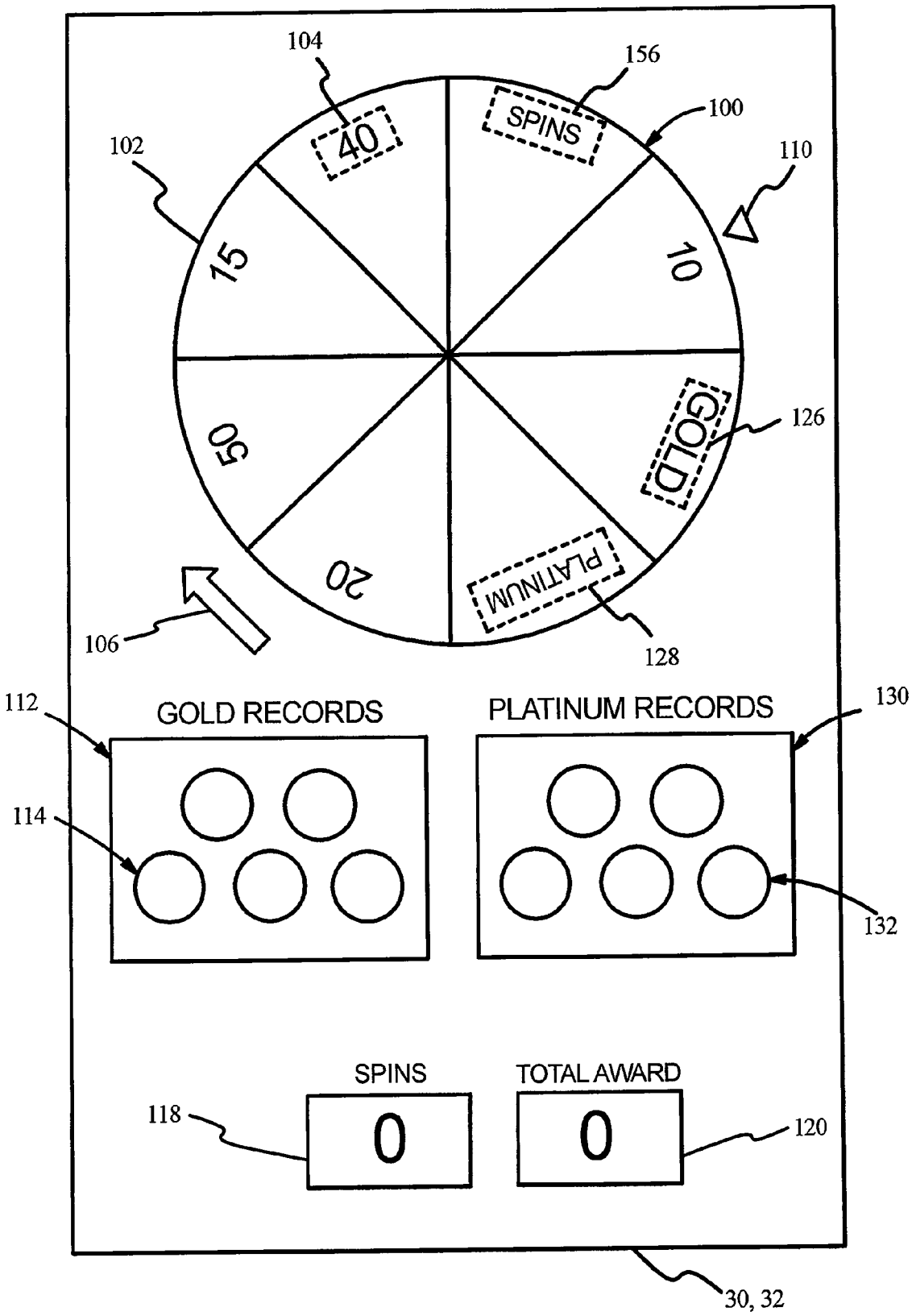
FIG. 9 is an enlarged elevation view of a display device illustrating another embodiment of the present invention where the award distributor in the form of an award wheel includes an additional spin symbol.

Referring now to FIG. 9, another embodiment of the present invention is illustrated where a section 102 on the award wheel 100 includes a selection group activator symbol 156 where the gaming device provides a player with additional spins or additional spins in the bonus game. In this embodiment, the player has an opportunity to obtain additional spins during the bonus game. If the section indicator 110 indicates selection group activator symbol 156, designated with the phrase "spins," the gaming device displays a plurality of selections as described in FIG. 7A or 8A, to the player. The player picks one or more selections as described above to obtain additional spins. The selection group activator symbol 156 increases the player's level of excitement in the bonus game because the player has an opportunity to obtain more spins and awards in the bonus game.

Figure 10:
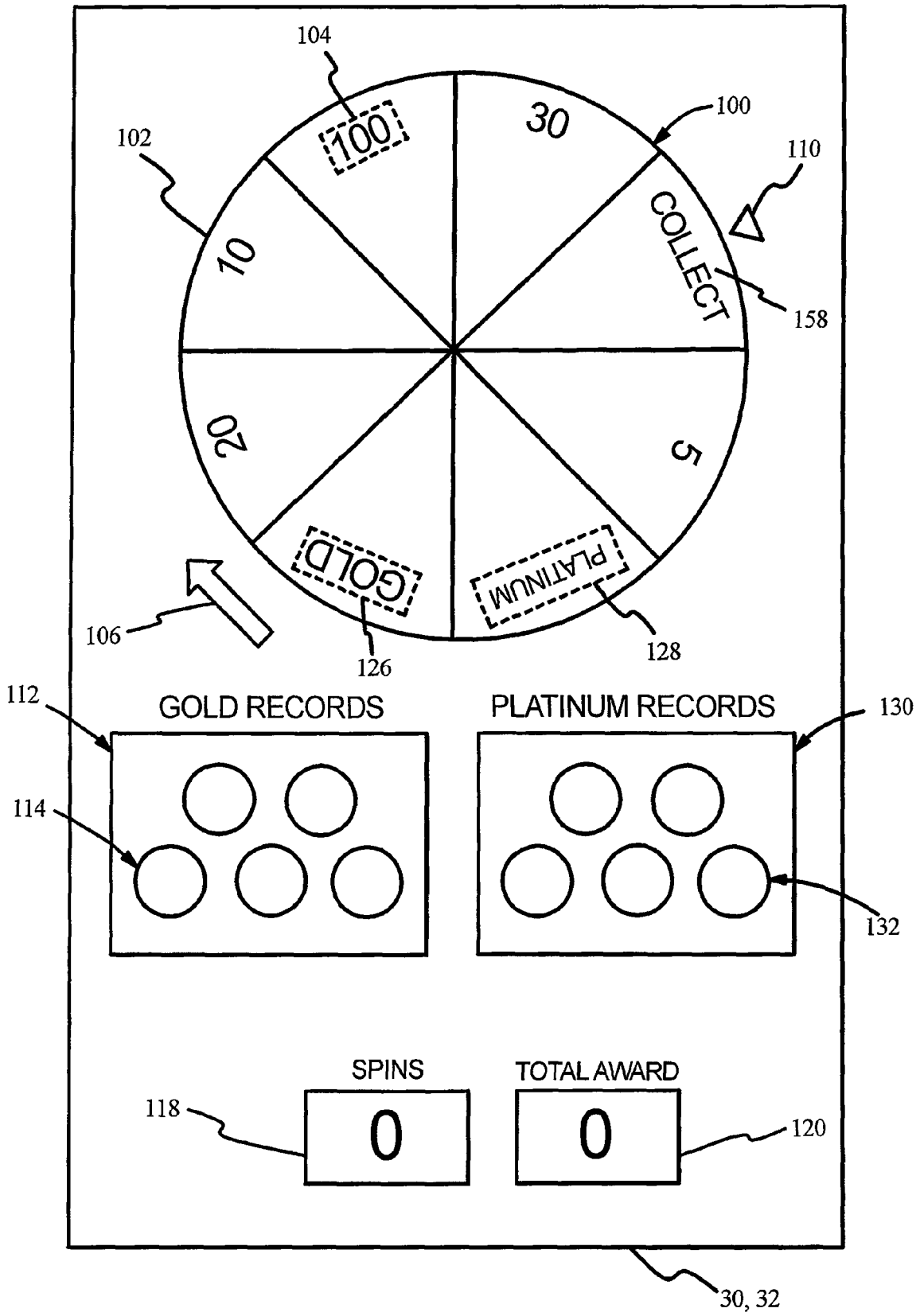
FIG. 10 is an enlarged elevation view of a display device illustrating another embodiment of the present invention where the award distributor in the form of an award wheel includes a terminator symbol.

Referring now to FIG. 10, a further embodiment of the present invention is illustrated where the award wheel 100 includes at least one terminator symbol or terminator 158. If a terminator symbol 158 is indicated by the section indicator 158, the game ends and the player receives the total award indicated by the total award display 120.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A method of operating a gaming system, said method comprising:

(a) causing at least one display device to display at least a first one of a plurality of plays of a game;

(b) after an occurrence of a first triggering event associated with at least the first one of the plurality of plays of the game:

(i) causing a pick of at least one of a plurality of selections of a selection set, wherein a plurality of awards are associated with the selections of the selection set, and (ii) causing at least one processor to reduce the number of selections of said selection set by at least one, (c) after the occurrence of the first triggering event, causing the at least one display device to display the play of at least a second, different one of the plurality of plays of the game;

(d) after an occurrence of a second triggering event associated with at least the second, different one of the plurality of plays of the game, causing a pick of at least one of the reduced number of selections of said selection set; and (e) providing a player any awards associated with the picked selections.

2. The method of claim 1, which is provided through a data network.

3. The method of claim 2, wherein the data network is an internet.

4. A method for operating a gaming system, said method comprising:

(a) for a single play of a game played after an occurrence of a single triggering event:

(i) activating an award distributor including award symbols and at least one selection group activator symbol;

(ii) causing at least one display device to display an award if an award symbol is indicated by the award distributor;

(iii) when a selection group activator symbol is indicated by the award distributor:

(A) causing the at least one display device to display a selection set having a plurality of selections wherein each selection is associated with an award, (B) causing a pick of one of said selections from said displayed selection set, (C) revealing the award associated with the picked selection, and (D) causing at least one processor to decrease the plurality of available selections in the displayed selection set which may be subsequently picked when the selection group activator symbol is subsequently indicated by the award distributor; and (iv) repeating steps (i) through (iii) at least once.

5. The method of claim 4, which is provided through a data network.

6. The method of claim 5, wherein the data network is an internet.

7. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display at least a first one of a plurality of plays of a game;

(b) after an occurrence of a first triggering event associated with at least the first one of the plurality of plays of the game:

(i) cause a pick of at least one of a plurality of selections of a selection set, wherein a plurality of awards are associated with the selections of the selection set, and (ii) reduce the number of selections of said selection set by at least one, (c) after the occurrence of the first triggering event, display the play of at least a second, different one of the plurality of plays of the game;

(d) after an occurrence of a second triggering event associated with at least the second, different one of the plurality of plays of the game, cause a pick of at least one of the reduced number of selections of said selection set; and (e) provide a player any awards associated with the picked selections.

8. A non-transitory computer readable medium including a plurality of instructions, which when executed by at least one processor, cause the at least one processor to:

(a) cause at least one display device to display at least a first one of a plurality of plays of a game;

(b) after an occurrence of a first triggering event associated with at least the first one of the plurality of plays of the game:

(i) cause a pick of at least one of a plurality of selections of a selection set, wherein a plurality of awards are associated with the selections of the selection set, and (ii) reduce the number of selections of said selection set by at least one, (c) after the occurrence of the first triggering event, cause the at least one display device to display the play of at least a second, different one of the plurality of plays of the game;

(d) after an occurrence of a second triggering event associated with at least the second, different one of the plurality of plays of the game, cause a pick of at least one of the reduced number of selections of said selection set; and (e) provide a player any awards associated with the picked selections.

9. A gaming system comprising:

at least one display device;

at least one input device;

at least one processor; and at least one memory device which stores a plurality of instructions, which when executed by the at least one processor, cause the at least one processor to operate with the at least one display device and the at least one input device to, for a single play of a game played after an occurrence of a single triggering event:

(a) activate an award distributor including award symbols and at least one selection group activator symbol;

(b) display an award if an award symbol is indicated by the award distributor;

(c) when a selection group activator symbol is indicated by the award distributor:

(i) display a selection set having a plurality of selections wherein each selection is associated with an award, (ii) cause a pick of one of said selections from said displayed selection set, (iii) reveal the award associated with the picked selection, and (iv) decrease the plurality of available selections in the displayed selection set which may be subsequently picked when the selection group activator symbol is subsequently indicated by the award distributor; and (d) repeat steps (a) through (c) at least once.

10. A non-transitory computer readable medium including a plurality of instructions, which when executed by at least one processor, cause the at least one processor to, for a single play of a game played after an occurrence of a single triggering event:

(a) activate an award distributor including award symbols and at least one selection group activator symbol;

(b) cause at least one display device to display an award if an award symbol is indicated by the award distributor;

(c) when a selection group activator symbol is indicated by the award distributor:

(i) cause the at least one display device to display a selection set having a plurality of selections wherein each selection is associated with an award, (ii) cause a pick of one of said selections from said displayed selection set, (iii) reveal the award associated with the picked selection, and (iv) decrease the plurality of available selections in the displayed selection set which may be subsequently picked when the selection group activator symbol is subsequently indicated by the award distributor; and (d) repeat steps (a) through (c) at least once.

* * * * *

UNITED STATES PATENT AND TRADEMARK OFFICE

CERTIFICATE OF CORRECTION

PATENT NO. : 8,142,274 B2
APPLICATION NO. : 12/014491
DATED : March 27, 2012
INVENTOR(S) : Anthony J. Baerlocher It is certified that error appears in the above-identified patent and that said Letters Patent is hereby corrected as shown below:

IN THE CLAIMS

In Claim 1, Column 16, Line 5, replace “the” with --a--.
In Claim 1, Column 16, Line 8, delete “the play of.”
In Claim 4, Column 16, Line 31, replace “a” with --the at least one--.
In Claim 4, Column 16, Line 40, replace “the” with --a--.
In Claim 4, Column 16, Line 43, between “the” and “selection” add --at least one--.
In Claim 7, Column 17, Line 1, replace “the” with --a--.
In Claim 7, Column 17, Line 4, delete “the play of.”
In Claim 8, Column 17, Line 25, replace “the” with --a--.
In Claim 8, Column 17, Line 28, delete “the play of.”
In Claim 9, Column 18, Line 7, replace “a” with --the at least one--.
In Claim 9, Column 18, Line 16, replace “the” with --a--.
In Claim 9, Column 18, Line 18, between “the” and “selection” add --at least one--.
In Claim 10, Column 18, Line 31, replace “a” with --the at least one--.
In Claim 10, Column 18, Line 40, replace the first instance of “the” with --a--.
In Claim 10, Column 18, Line 42, between “the” and “selection” add --at least one--.

Signed and Sealed this
Twenty-sixth Day of November, 2013

Margaret A. Focarino

Margaret A. Focarino
*Commissioner for Patents of the United States Patent and Trademark Office*